US005787951A

United States Patent [19]

Tonomura et al.

[11] Patent Number: 5,787,951

[45] Date of Patent: Aug. 4, 1998

[54] ROMAN SHADE

[75] Inventors: Hideaki Tonomura; Hidehiko Nakamura; Hiroomi Yamanaka; Akira Sone; Toshikazu Okita, all of Tokyo, Japan

[73] Assignee: Kabushiki Kaisha Nichibei, Tokyo, Japan

[21] Appl. No.: 735,259

[22] Filed: Oct. 22, 1996

[51] Int. Cl.[6] ..... A47H 5/00

[52] U.S. Cl. ..... 160/84.01; 160/84.03; 160/89

[58] Field of Search ..... 160/84.01, 84.03, 160/89, 330, 113, 168.1 R, 176.1 R, 179, 237

[56] References Cited

U.S. PATENT DOCUMENTS

| | | | |
|---|---|---|---|
| 5,205,334 | 4/1993 | Judkins | 160/84.03 X |
| 5,490,553 | 2/1996 | Colson et al. | 160/89 X |
| 5,503,210 | 4/1996 | Colson et al. | 160/84.01 X |
| 5,547,006 | 8/1996 | Auger | 160/84.01 |

FOREIGN PATENT DOCUMENTS

| | | | |
|---|---|---|---|
| 482794 | 4/1992 | European Pat. Off. | 160/84.01 |
| 0654577 | 5/1995 | European Pat. Off. . | |
| 7-39449 | 2/1995 | Japan . | |
| 1494842 | 12/1977 | United Kingdom . | |
| 85/02760 | 7/1985 | WIPO | 160/84.01 |
| 9429559 | 12/1994 | WIPO . | |

*Primary Examiner*—Blair Johnson
*Attorney, Agent, or Firm*—Greenblum & Bernstein P.L.C.

[57] ABSTRACT

An opaque or semitransparent rear sheet hangs from a head rail and is weighted at the bottom by a ballast ber. A number of front sheets are hung from the rear sheet, each front sheet extending laterally across the full lateral width of the rear sheet. The rear sheet is raised by a raising cord to raise the entire shade. The front sheets are raised by an opening cord to open the front sheets with respect to the rear sheet, creating openings and exposing the rear sheet through the openings. The front sheets form folds when raised, and may have lateral members attached thereto for defining the shape of the opening.

18 Claims, 38 Drawing Sheets

ROMAN SHADE

BACKGROUND OF THE INVENTION

1. Field of the Invention

The present invention relates to a roman shade, and more particularly, to a roman shade that allows flexibility and variety in the appearance of the shade.

2. Description of Relevant Materials

One kind of conventional roman shade is formed as a cloth hanging from a head rail, having a lower end provided with weights at given lateral intervals. This kind of roman shade can be raised by drawing up a raising cord or cords, forming large, loose folds in the cloth at equal vertical distances.

Another kind of conventional shade hangs from an upper rail, but has an attached weight bar extending over the full lateral length of the lower end, and operates similarly.

In these conventional roman shades, the shape or size of folds formed in the cloth as the cloth is raised are determined by the positions of the connection of the cords to the cloth, or by the shape of the cloth itself. The conventional roman shade allows viewing therethrough, i.e., a viewing function, if a transparent or semitransparent material is used as the cloth. Alternatively, a screening function can be provided by the shade with the use of an opaque cloth.

However, with the known roman shades, the appearance of the cloth is the same each time it is raised, i.e., the roman shade cannot form different shapes. Furthermore, if one desires to obtain both a viewing function and a screening function, two roman shades, one made of semitransparent cloth and a one made of opaque cloth, must be used simultaneously. Still further, in order to control the quantity of the light admitted to a room by the conventional roman shade, one can only raise the shade itself. Fine control of the quantity of light admitted is impossible.

One known shade allowing both a viewing function and a screening function is disclosed in commonly assigned Japanese Patent Publication HEI 7-39449. The publication discloses a roman shade having an upper end of a cloth hanging from head rail, all the loops or folds of the cloth being attached to cords. Loops or folds are formed in the cloth at given vertical intervals. Front upper portions of the loops or folds are attached to a supporting cord, while rear upper portions of the loops or folds are connected to a moving cord. The cloth itself is semitransparent when not overlapped with another sheet of the cloth, but becomes opaque when multiple layers (i.e., formed from the loops) of the cloth are overlapped. In order to provide a screening function, the loops or folds of the cloth are overlapped. In order to provide a viewing function, the loops or folds are prevented from overlapping. The loops or folds are moved by moving the moving cord relatively to the supporting cord.

However, since the shade disclosed in this publication uses only one cloth to provide both a viewing function and a screening function, the appearance of the cloth cannot be changed when the user desires, in that the shade cannot show more than one texture, pattern or color. Although the overlapping condition of the cloth changes when drawn, the external appearance of the shade cannot be dramatically changed.

SUMMARY OF THE INVENTION

One object of the invention is to overcome the disadvantages listed above by providing a shade that can change its shape, color, texture, and pattern, allowing a dramatic change in the appearance of the shade. Another object is to provide a shade having both a viewing function and a screening function, and allowing regulation of the amount of light admitted through the shade.

The above objects are attained by providing, according to one aspect of the present invention, a roman shade including a head rail and a ballast bar, and a rear sheet connected to the head rail and to the ballast bar. A raising cord extends along a rear face of the rear sheet from the head rail and is connected to the ballast bar. A number of front sheets are arranged at predetermined vertical intervals facing the rear sheet, and each of the front sheets has an attachment to a front face of the rear sheet. An opening cord extends vertically from the head rail, is connected to each of the front sheets at a first predetermined position displaced from the attachment, and is vertically movable. Preferably, the front sheets are raised by the opening cord to expose the rear sheet through a number of openings corresponding to the raised front sheets, the openings being of varying size depending on an amount of raising of the front sheets.

Accordingly, in addition to the functions of a conventional roman shade, since the front sheets can be partially or fully opened by the opening cord to expose the rear sheet, the shade can change in appearance, including shape, color, texture, and pattern. When a transparent or semitransparent rear sheet is used, a viewing function is obtained when the rear sheet is exposed. Furthermore, the quantity of light admitted through the shade is finely controlled according to the amount that the front sheets are opened. Still further, since the front sheets can be made of a material different from that of the rear sheet, the appearance can be varied in two ways.

The above objects are also attained by another aspect of the present invention, in which a roman shade includes a head rail, a rear sheet connected to the head rail, and a number of front sheets arranged at predetermined vertical intervals facing the rear sheet, each of the front sheets having an attachment to a front face of the rear sheet. A raising cord for raising and lowering the rear sheet extends from the head rail and passes through each of the attachments, and an opening cord extends vertically from the head rail, connects to each of the front sheets at a first predetermined position displaced from the attachment, and is vertically movable. The front sheets are raised by the opening cord to expose the rear sheet through a number of openings corresponding to the raised front sheets. The openings vary in size depending on an amount of raising of the front sheets.

Accordingly, if viewed from the outside of a room (i.e., the back of the roman shade), no raising cords are visible, improving the external appearance of the roman shade. Still further, since the front sheets form frontward-projecting folds when raised and the rear sheet forms backward-projecting folds when raised, the front and rear sheets do not lie upon one another, so the shade is folded neatly and without bulkiness. In addition, by passing the opening cords and raising cords through the same pass-through portion, the shade is simpler to manufacture.

The roman shades may include a stopper or stoppers, positioned inside the head rail, for restraining one or both (if two stoppers are provided) of the raising cord or the opening cord introduced through the stopper or stoppers to the outside of the head rail. If the pulling end of the opening cord is further introduced or drawn to the outside of the head rail, the front sheets are opened, partially exposing the rear sheet. If the pulling end of the raising cord is further introduced or drawn to the outside of the head rail, the rear sheet is raised together with the front sheets, and therefore the entire shade is raised. Both of the raising cord and opening cord may be controlled by separate stoppers.

The roman shades may alternatively incorporate a drum or drums, positioned inside the head rail, for winding one or both (if two drums are provided) of the raising cord and the opening cord on the drum or drums, and a drum drive or drives, the drum drive(s) being externally controlled. If the pulling end of the opening cord is wound on a drum, the front sheets are opened when the drum is rotated, partially exposing the rear sheet. If the pulling end of the raising cord is wound on a drum, the rear sheet is raised together with the front sheets when the drum is rotated, and therefore the entire shade is raised. Both cords may be wound by separate drums.

The first predetermined position on the front sheets, to which the opening cord is attached, is optionally a lower end of each of the front sheets, and the opening cord is passed through each of the front sheets at a second predetermined position nearer to the attachment than the first predetermined position. As the attached portion of the opening cord is raised, the lower end of each forward sheet is raised, exposing the rear sheet. Each of the front sheets forms a fold between the second predetermined position where the opening cord passes through the front sheet and the first predetermined position at a lower end of the front sheet.

The rear sheet may be connected to the head rail at a rear portion of the head rail, in which case the raising cord extends along a front face of the rear sheet. Therefore, it is unnecessary to provide the rear sheet with a pass-through hole for introducing the raising cord from the rear face to the front face of the rear sheet. The absence of this pass-through hole simplifies the construction, increases the strength of the rear sheet by removing a source of abrasion damage (rubbing of raising cord on the wall of the pass-through hole).

The opening cord optionally extends from the head rail along the front face of the rear sheet displaced by a predetermined spacing from the rear sheet, the first predetermined position (the position to which the opening cord is attached) being halfway between a lower end of each front sheet and the attachment of the front sheet to the rear sheet. In this case, the opening cord passes through each of the front sheets at the first predetermined position. Accordingly, as the opening cord is drawn up, the front sheet is raised at the halfway position, accompanied by the remainder of the front sheet. The rear sheet is thereby exposed. Further, when the front sheets are lowered, a spacing is formed between a lower end portion of each front sheet and an upper end portion of the next lower front sheet. When a transparent or semitransparent rear sheet is used, light can be indirectly admitted through the spacing to provide indirect lighting to a room.

The roman shade may include a number of lower lateral bars corresponding to the front sheets. Each front sheet is attached to a corresponding lower lateral bar at a lower end portion thereof, and each lower lateral bar extends laterally across the corresponding front sheet. The lower lateral bar may extend across the entire front sheet or a portion thereof. The front sheets are raised by the opening cord to expose the rear sheet through a number of openings corresponding to the raised front sheets, and the openings vary in size depending on an amount of raising of the front sheets. The openings have rectilinear top edges at positions corresponding to the lower lateral bars. If the lower lateral bar extends across the full lateral length of the front sheet, when the opening cord is drawn, the full length of the lower end portion of each front sheet is raised linearly, forming regular folds in the front sheet. If the lateral bars are extend across only a portion or portions of the lateral length of each front sheet, the portions corresponding to the lateral bars incline linearly, while the remaining portions of the front sheets form draped or wavy shapes.

In such a case, the roman shade may further include a number of central lateral bars corresponding to the front sheets. Each front sheet is attached to a corresponding central lateral bar at a portion of the front sheet halfway between the lower lateral bars and the attachment. The central lateral bars weight the front sheets to form folds at the portions of the front sheets halfway between the lower lateral bars and the attachments. Accordingly, when the opening cords are drawn up, the middle portion of each front sheet becomes the lowest portion thereof, and the raised front sheets form sharply defined folds.

The front sheets may be alternatively formed from a stiff material, each of the front sheets having one or more foldable regions extending laterally across the front sheet, and the foldable region or regions being formed between a lower end portion of each front sheet and the attachment. Optionally, a number of foldable regions are formed between the lower end portion of each front sheet and the attachment. Accordingly, when the opening cord is raised, since the stiff front sheet does not hang down, but is folded along the foldable region(s), the opening between the adjacent front sheets is larger than the case where a stiff material is not used. Consequently, the rear sheet is exposed to a larger extent. If more foldable regions are formed in the front sheet, the rear sheet can be exposed to an even larger extent.

Alternatively, one or more spacer cords are provided to the roman shade. A central lateral bar is attached to each of the front sheets midway between a lower end portion of each front sheet and the attachment, each central lateral bar extending laterally across the corresponding front sheet. the spacer cords support the central lateral bars at positions displaced from the rear sheet. In this case, the front sheets are raised by the opening cord to expose the rear sheet through openings corresponding to the raised front sheets and the one spacer cord or cords hold the central lateral bars in position when the front sheets are raised. Accordingly, when the opening cord is drawn up, since a portion of the lateral bar attached to the front sheet is connected to the spacer, the central lateral bar does not hang down. That is, only the lower end of the front sheet is raised, while the central lateral bar is maintained in position by the spacer. Therefore, the opening area is improved in comparison to the case where a central lateral bar is not connected to a spacer. Furthermore, since the spacer is arranged at a distance from the rear sheet, the front sheets form a triangular shape when viewed from the side of the cloth, allowing variety in the three dimensional shape of the shade.

In another alternative structure, the roman shade includes a valance cloth corresponding to each of the front sheets. Each of the valance cloths extends from the attachment to a position approximately midway between a lower end portion of each front sheet and the attachment. In this case, when the opening cord is drawn up, the front sheets are covered by the valance cloths.

In still another alternative structure, the roman shade includes pass-through rings attached to a back face of each of the front sheets, and the opening cord passes through corresponding pass-through rings. Accordingly, when the opening cord is drawn up, the opening cord is pulled up through successive pass-through rings, in order from lower pass-through rings toward higher pass-through rings, successively forming folds in the front sheets between adjacent pass-through rings. Consequently, the front sheets do not form large, hanging folds, but instead are compressed in the vertical direction while forming small folds. The opening area is thereby increased, and the extent to which the rear cloth is exposed is also increased.

In yet another alternative structure, the rear sheet is formed as a number of vertical strips distributed in the lateral direction of the head rail. Accordingly, if the front sheets are opened (raised), through-openings are formed between vertically adjacent front sheets and between laterally adjacent vertical strips of the rear sheet. Therefore, a viewer may look directly through the shade when the front sheets are opened. Again, the shade can change in appearance, including shape, color, texture, and pattern.

Optionally, the roman shade may include a valance cloth hanging from the head rail for covering an upper end portion of the uppermost front sheet.

The above objects are further attained by still another aspect of the present invention, in which a roman shade includes a hanging rear sheet and a plurality of front sheets attached at vertical intervals to the rear sheet and hanging from the rear sheet. A raising cord is operatively connected to the rear sheet so that the rear sheet is raised and lowered together with the front sheets, and an opening cord is operatively connected to the front sheets so that the front sheets are opened and closed with respect to the rear sheet. One or more one ballast portions is provided for weighting and straightening the roman shade. Preferably, the front sheets are attached at an upper end thereof to the rear sheet, and operatively connected at a lower end thereof to the opening cord, so that the front sheets form folds when the front sheets are opened with respect to the rear sheet.

DETAILED DESCRIPTION OF THE PREFERRED EMBODIMENTS

Figure 1:
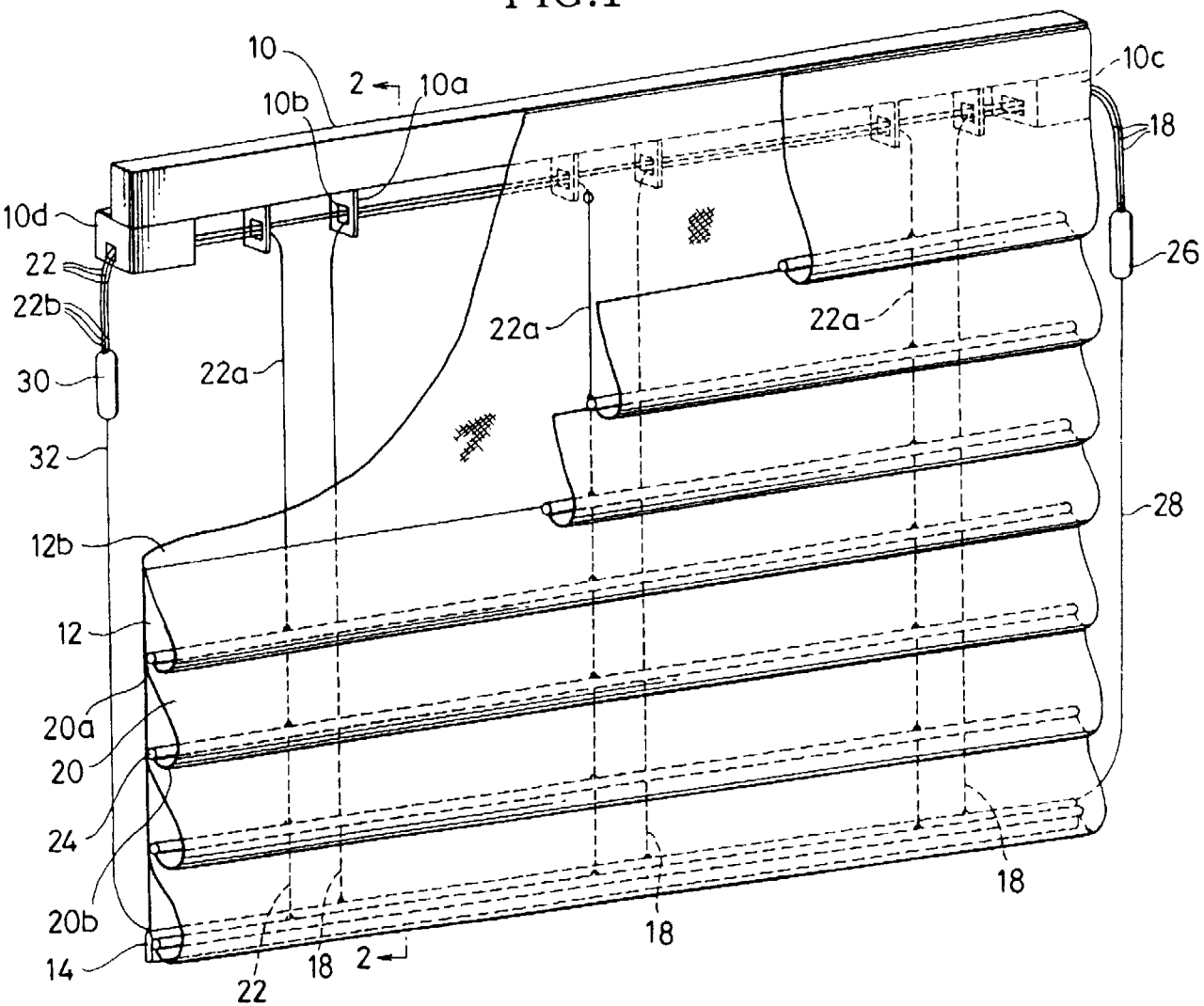
FIG. 1 is a perspective view of a first embodiment of a roman shade according to the present invention.
Figure 2:
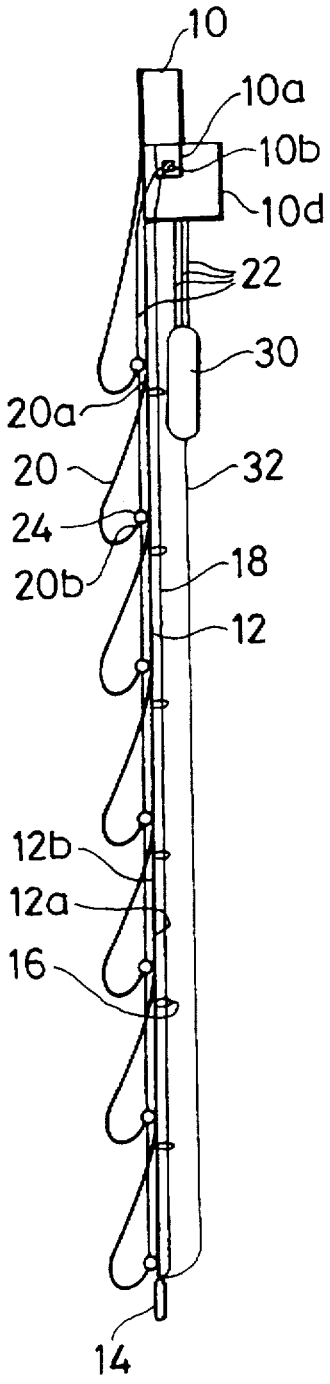
FIG. 2 is a sectional view taken along line II—II of FIG. 1.
Figure 3:
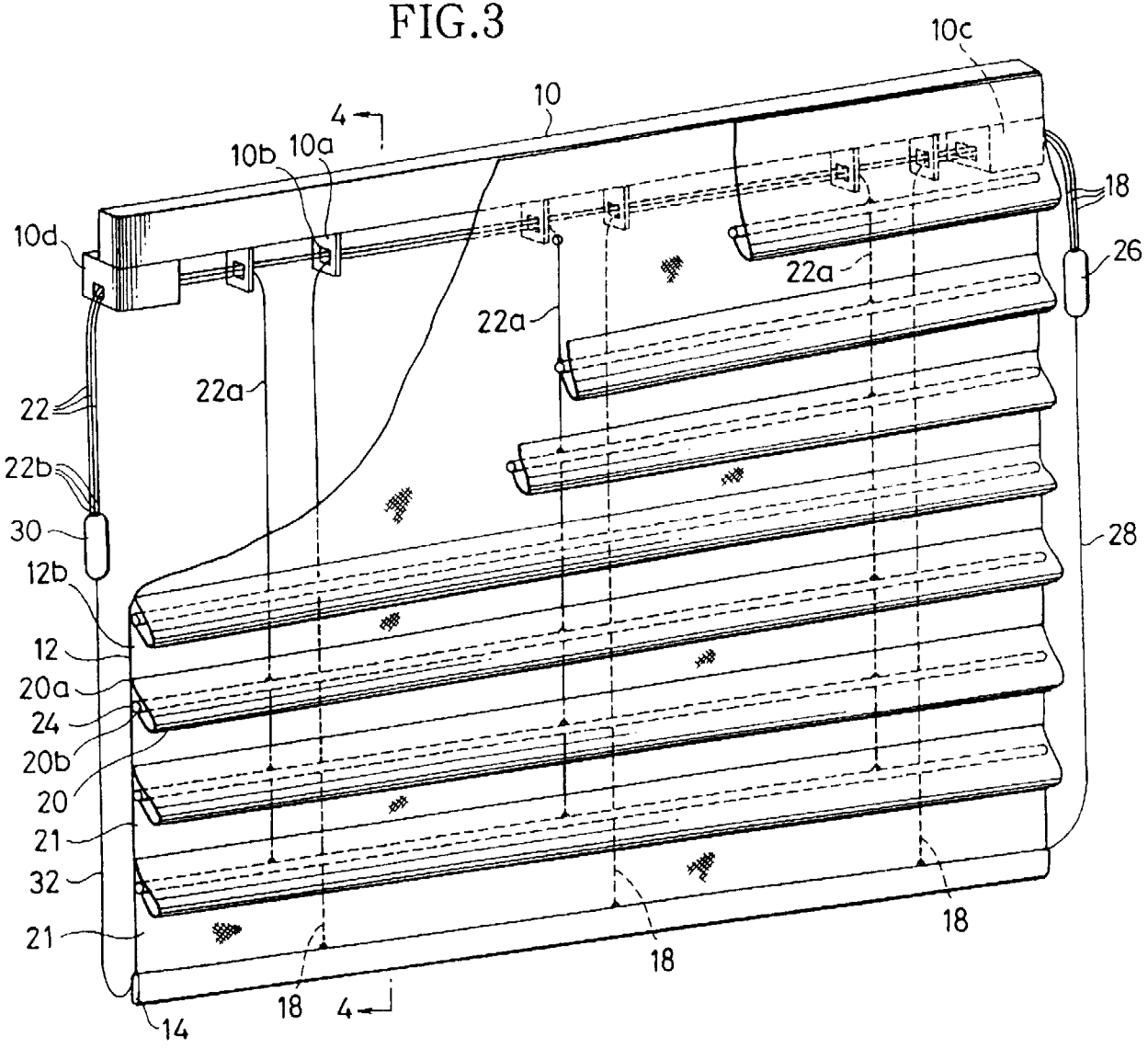
FIG. 3 is a partially cutaway perspective view of the roman shade of FIG. 1, with the front sheets drawn up.
Figure 4:
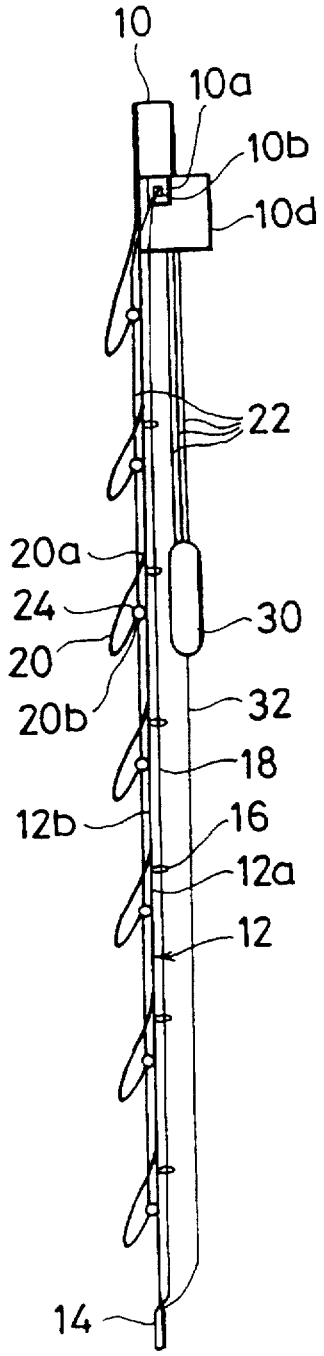
FIG. 4 is a sectional view taken along line IV—IV of FIG. 3.

FIGS. 1 and 2 show a first embodiment of a roman shade according to the present invention. As shown in FIG. 1, the roman shade includes a rear sheet 12 attached at an upper end thereof to a head rail 10, and hanging from the head rail 10. The lower end of the rear sheet 12 is connected to and weighted by a ballast bar 14. A plurality of cord rings 16 are attached to the rear surface 12*a* of the rear sheet 12, vertically distributed at positions corresponding to attached front sheets 20 (described later).

As hereinafter described, "opening cords" provide both opening and closing functions, and "raising cords" provide both raising and lowering functions.

Raising cords 18 are connected at an anchor end thereof to the ballast bar 14, extend through the cord rings 16, and enter pass-through holes 10*b* of cord guides 10*a* attached to the lower portion of the head rail 10. The raising cords 18 are then introduced through a first stopper 10*c* provided at the right hand side of the head rail 10 (as shown in FIG. 1), and extend beyond the head rail 10. The remaining (pulling) ends of the raising cords 18 are all connected to a raising grip 26, which is used to draw the raising cords 18. The raising grip 26 is connected at its lower end to a raising return cord 28, which extends to connect to the ballast bar 14. Accordingly, the raising cords 18 can be pulled in upward or downward directions.

A plurality of front sheets 20, which extend across the full lateral length of the rear sheet 12, are evenly vertically distributed on the front face of the rear sheet 12. Each of the front sheets 20 is connected, at an attachment along the upper end portion 20*a* thereof, to the rear sheet 12. Each individual front sheet 20 is provided with a lateral bar 24 attached to a lower end portion 20*b*. The lateral bars 24 extend across the full lateral length of the front sheets 20.

Opening cords 22 extend along the full vertical length of the rear sheet 12, the opening cords 22 passing through (and movable with respect to) each of the front sheets 20 near the corresponding attachment to the back sheet 12. The opening cords 22 are further attached at an anchor end thereof to all of the lateral bars 24. When any front sheet 20 is in a closed position (i.e., lowered), the corresponding lateral bar 24 overlaps an upper portion 20*a* of the next lower front sheet 20. In this manner, each front sheet 20 forms a large, loose fold that overlaps the individual front sheets 20 immediately below, the large loose fold projecting slightly forward.

The opening cords 22 are provided at three distributed locations along the lateral width of the front sheets 20 and rear sheet 12. Each individual opening cord 22 passes through a cord guide 10*a*, and is introduced through a second stopper 10*d* positioned at the left hand side (in FIG. 1) of the head rail 10. The opening cords then extend beyond the head rail 10, and the pulling ends 22*b* of each opening cord 22 are connected to an opening grip 30. The opening grip 30 is connected at a lower end thereof to a opening return cord 32, which is further connected to the ballast bar 14. Accordingly, the opening cords 22 can be pulled in upward or downward directions.

FIG. 1 shows the first embodiment of a roman shade in a position where the front sheets 20 are closed, i.e., the large, loose fold of each front sheet 20 is positioned such that the corresponding lateral bar 24 is at its lowest position. As shown in FIG. 1, the front sheets 20 may be opened (i.e., raised) by pulling down on the opening grip 30, thereby drawing down the pulling ends 22*b* (the portions extending beyond the head rail 10) of the opening cords 22, at the same time drawing up the anchor ends 22*a* (the portions underneath the head rail 10) of the opening cords 22. The opening of the front sheets 20 forms an opening 21 between a lower end portion of the fold in each front sheet 20 and the upper end portion of the next lower front sheet 20, and between the lower end portion of the fold in the lowermost front sheet 20 and the ballast bar 14. Consequently, the rear sheet 12 is exposed through the openings 21. The front sheets 20 can be maintained in their opened positions by preventing the movement of the opening cords 22 using the second stopper 10*d*.

In order to open the front sheets 22 from a closed position, the second stopper 10*d* is released by moving the opening cords 22 with the opening grip 30. The anchor ends 22*a* of the opening cords 22 are thereby lowered to their lowermost positions by the free weight of the lateral bars 24 attached to the lower ends of the front sheets 20, returning to the state shown in FIG. 1. Optionally, the descent of the front sheets can be stopped at any position using the second stopper 10*d*.

Figure 5:
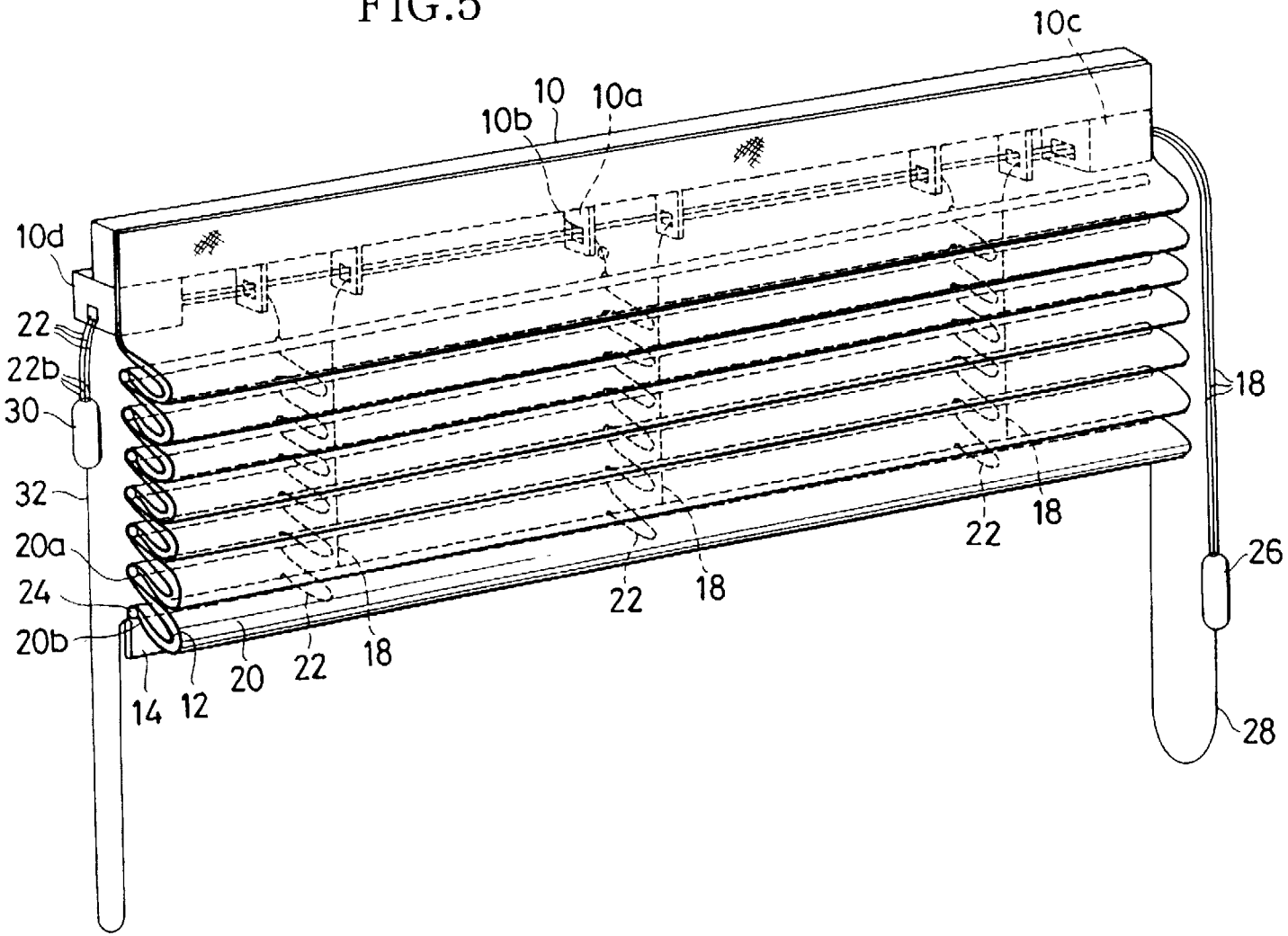
FIG. 5 is a perspective view of the roman shade of FIG. 1, in which a rear sheet is raised.

In order to raise the rear sheet 12 (together with the front sheets 20, i.e., raising the entire shade), the raising knob 26 is pulled down, thereby drawing a pulling end of the raising cords 18 down and an anchor end of the raising cords 18 up. In this manner, the ballast bar 14 is raised, forming a series of folds in the rear sheet 12. As the ballast bar 14 is brought into contact with the lowermost cord ring 16, the lowermost cord ring 16 is raised together with the weight bar 14, forming a fold in the rear sheet 12 between the lowermost cord ring 16 and the ballast bar 14. As the ballast bar 14 is drawn up further, forming successive folds at each cord ring 16, eventually the entire rear sheet 12 is raised up in successive folds formed between successive cord rings 16. Since the upper end portions 20*a* of the front sheets 20 are attached to the back sheet 12 at positions corresponding to the positions of the cord rings 16 (as shown in FIG. 5), the cord rings 16 on the rear sheet 12 and the upper end portions 20*a* of the front sheets 20 enter positions toward the rear of the folded assembly. Meanwhile, regular folds project forward over the full lateral length of the rear sheet 12 as the rear sheet 12 is raised.

As described, by drawing down the pulling ends 22*b* and drawing up the anchor ends 22*a* of the opening cords 22, openings 21 are formed between each front sheet 20 and the next lower front sheet 20, and between the lowermost front sheet 20 and the ballast bar 14. Consequently, the rear sheet 12 is exposed through the openings 21, and the shade can change in appearance, including shape, color, texture, and pattern.

Furthermore, by using a rear sheet 12 made of transparent or semitransparent material, the roman shade according to the first embodiment allows an operator to obtain a view through the rear sheet 12 and the openings 21. The raising or lowering of the rear sheet 12 (and the entire shade) can be stopped at any position using the first stopper 10*c*, and the opening and closing of the front sheets 20 can be stopped at any position using the second stopper 10*d*. Still further, the quantity of light transmitted through the rear sheet 12 and the roman shade (overall) can be finely regulated by controlling the extent to which the front sheets 20 are drawn up. Accordingly, the regulation of light transmission is also possible.

Figure 6:
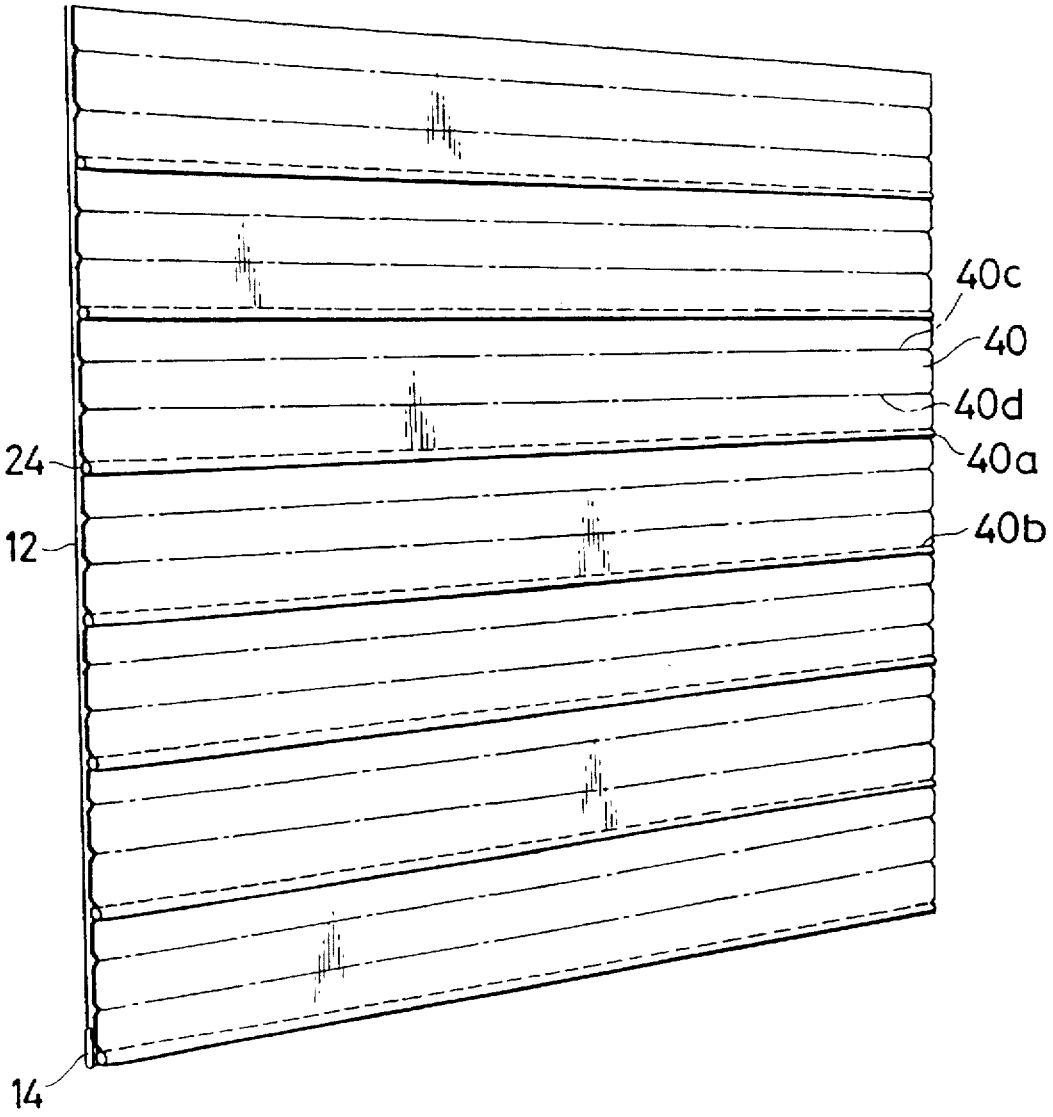
FIG. 6 is a perspective view of a second embodiment of a roman shade according to the present invention.

FIG. 6 shows a second embodiment of a roman shade according to the present invention. The second embodiment has the same general structure as the first embodiment, exceptions including that the front sheets 40 of the second embodiment are made of a hard, rigid or stiff material, and are formed with folds therein. Each front sheet 40 of the second embodiment is formed with a first fold 40*c* and a second fold 40*d*, each of the folds 40*c* and 40*d* extending across the full lateral length of each individual front sheet 40, and each of the folds 40*c* and 40*d* being easily bent. The first fold 40*c* and second fold 40*d* are arranged at equal intervals along the vertical direction of each individual front sheet 40.

Figure 7:
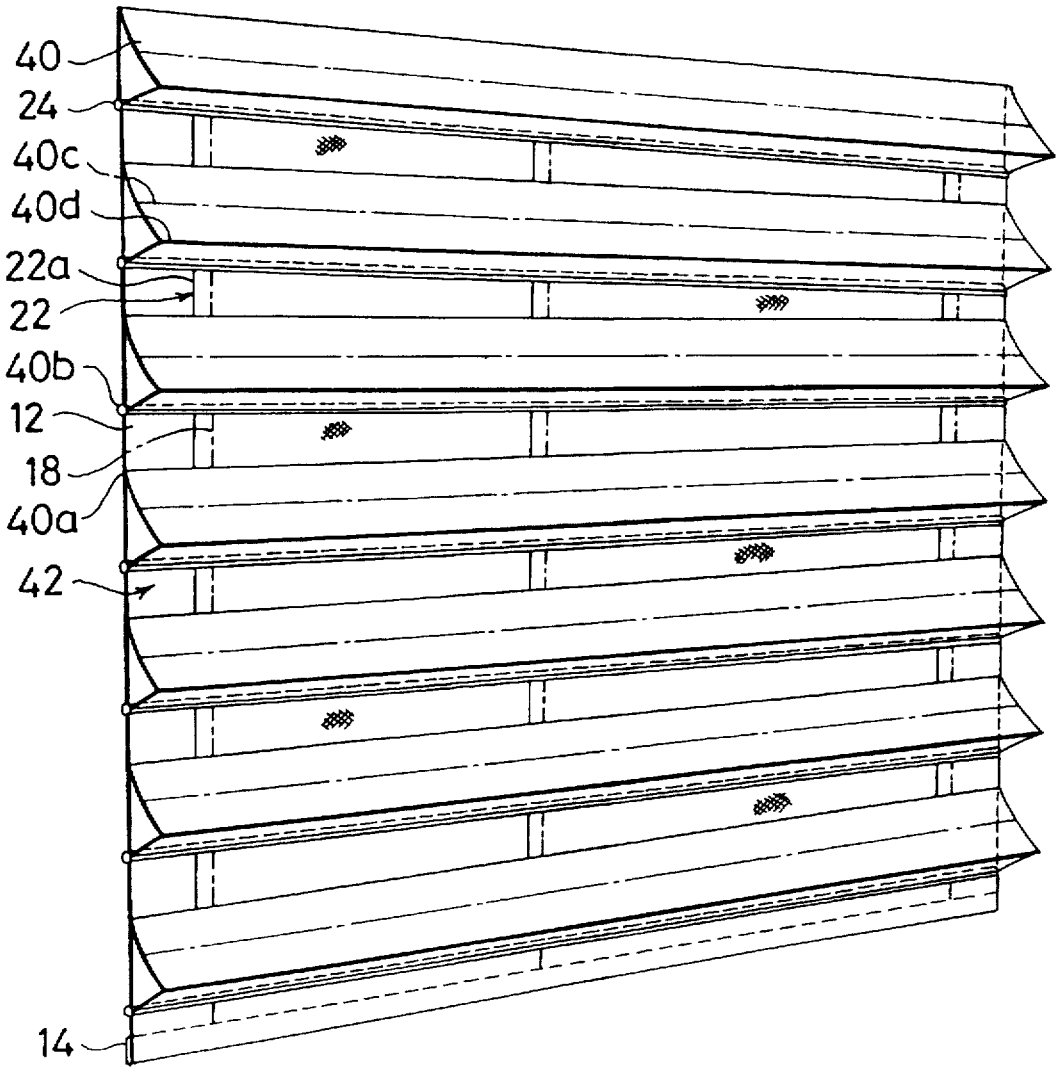
FIG. 7 has a perspective view of the roman shade of FIG. 6, in which front sheets are partially opened.

From the fully closed position, when opening (raising) the front sheets 40, the operation is similar to that of the first embodiment. However, in this case, the anchor ends 22*a* of the opening cords 22 are drawn up, moving each lateral bar 24 to a position halfway between the upper end portion and lower end portion of the corresponding front sheet 40. Initially, only the second fold 40*d* is bent in this manner. As shown in FIG. 7, since the front sheets 40 are made of a rigid material, the front sheets 40 project into the shape of a triangle having a vertex at the second fold 40*d*. At the same time, openings 42 are formed between the lower end portion 40*b* of each front sheet 40 and the adjacent upper end portion 40*a* of the next lower front sheet 40, and between the lower end portion 40*b* of the lowermost front sheet 40 and the ballast bar 14. Consequently, the rear sheet 12 is exposed via the openings 42.

Figure 8:
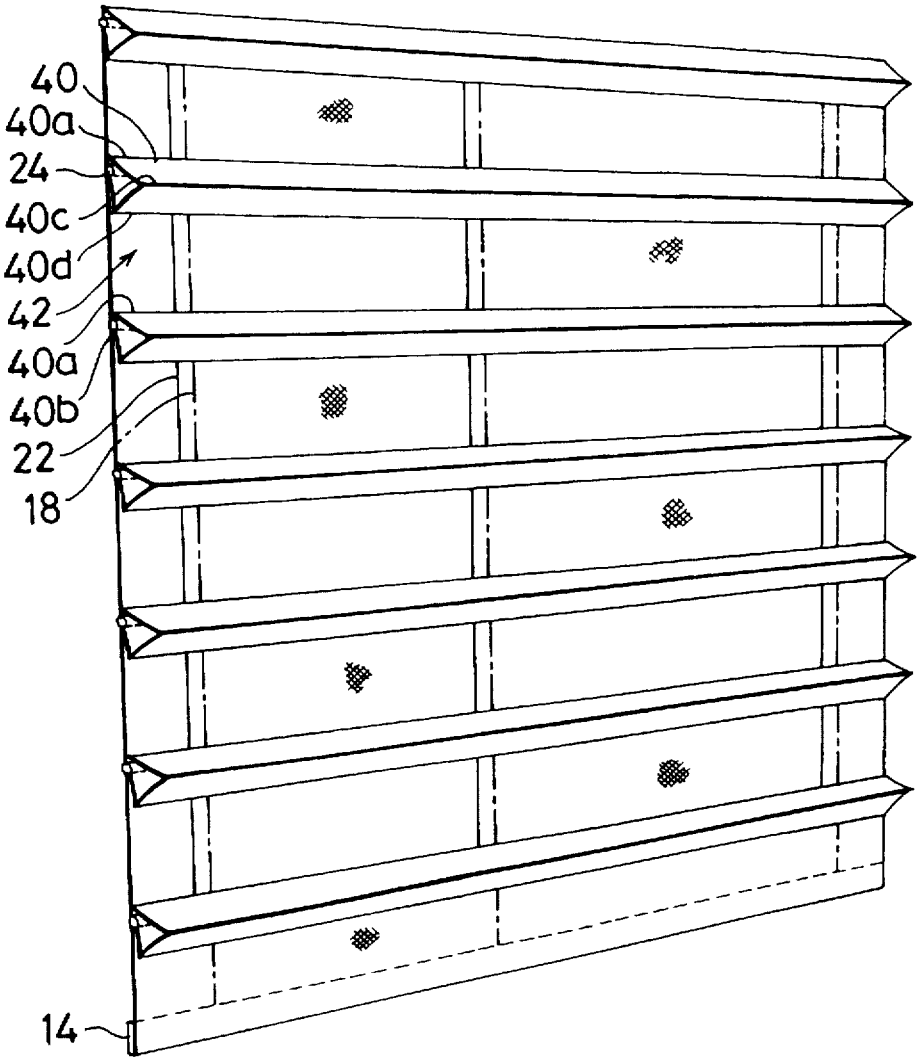
FIG. 8 is a perspective view of the roman shade of FIG. 6, in which front sheets are fully opened.

As the opening cord 22 is further drawn up, the front sheets 40 are fully opened. In the same manner as the first embodiment, the anchor ends 22*a* of the opening cords 22 are pulled up to positions where the movement of the lateral bars 24 is prevented by the upper end portions 40*a* of the front sheets 40 (at their attachments to the rear sheet 12). As shown in FIG. 8, the second folds 40*d*, previously bent, become the lowermost portions of the front sheets 40, and the first folds 40*c* are then bent, projecting forward into the shape of a triangle. The new triangle shape has a vertex at the first fold 40*c*. Accordingly, the front sheets cover approximately ⅓ of their fully closed area, and the area of each opening 42 is approximately ⅔ of the corresponding (fully closed) front sheet 40 area. In this fashion, the rear sheet 12 is exposed to a greater extent. Consequently, the shade can change in appearance, including shape, color, texture, and pattern. Furthermore, when a transparent or semitransparent material is used to form the rear sheet 12, the openings 42 can be viewed through.

In order to close (i.e., lower) the front sheets 40, the same operation as in the first embodiment is performed, returning the front sheets 40 to the state shown in FIG. 6. In order to raise the rear sheet 12 (i.e., in order to raise the roman shade), the same operation as in the first embodiment is performed. Accordingly, the raising or lowering of the rear sheet 12 (and the entire shade) can be stopped at any position using the first stopper 10*c*, and the opening and closing of the front sheets 40 can be stopped at any position using the second stopper 10*d*.

Figure 9:
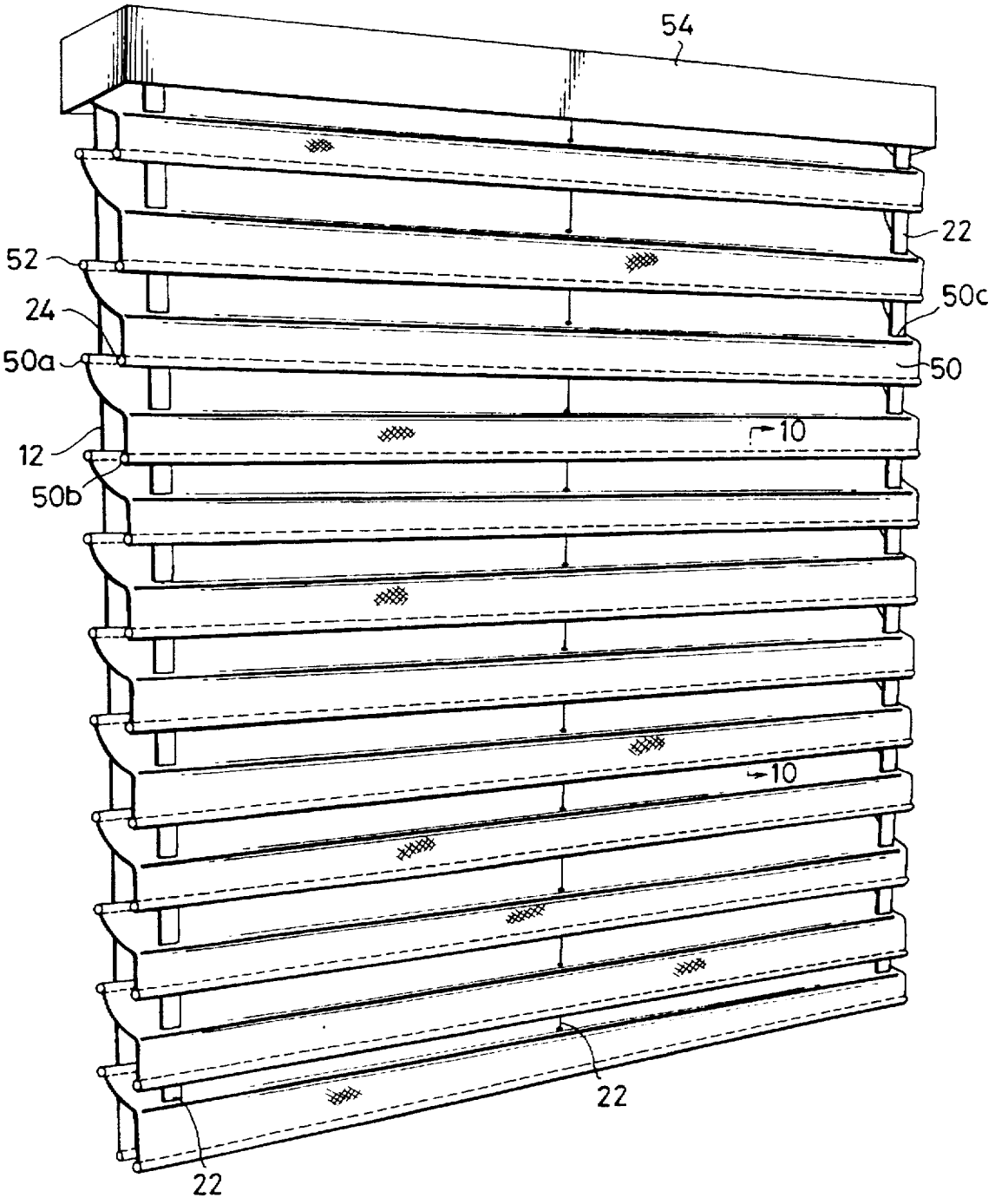
FIG. 9 is a perspective view of a third embodiment of a roman shade according to the present invention.
Figure 10:
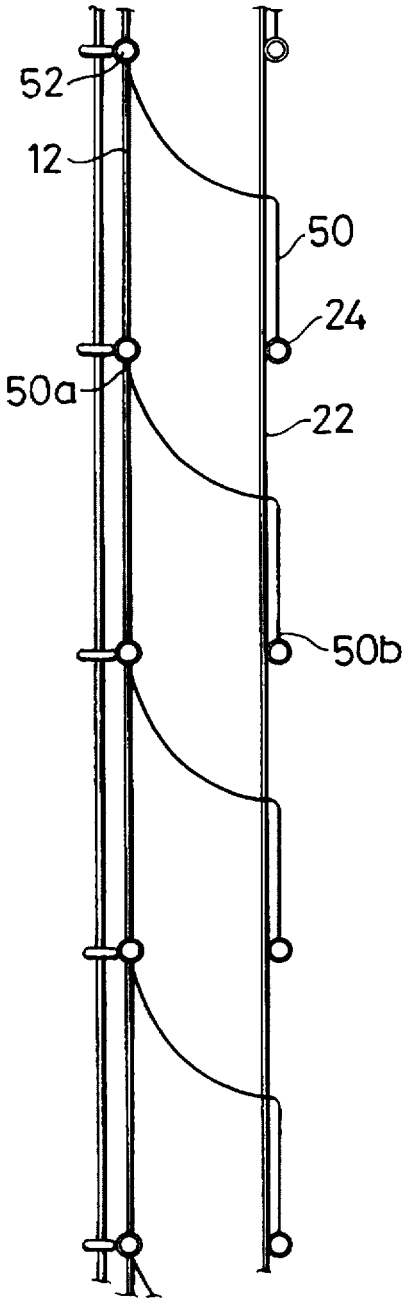
FIGS. 10A and 10B are sectional views taken along line X—X of FIG. 9, showing different positions of the shade.
Figure 10:
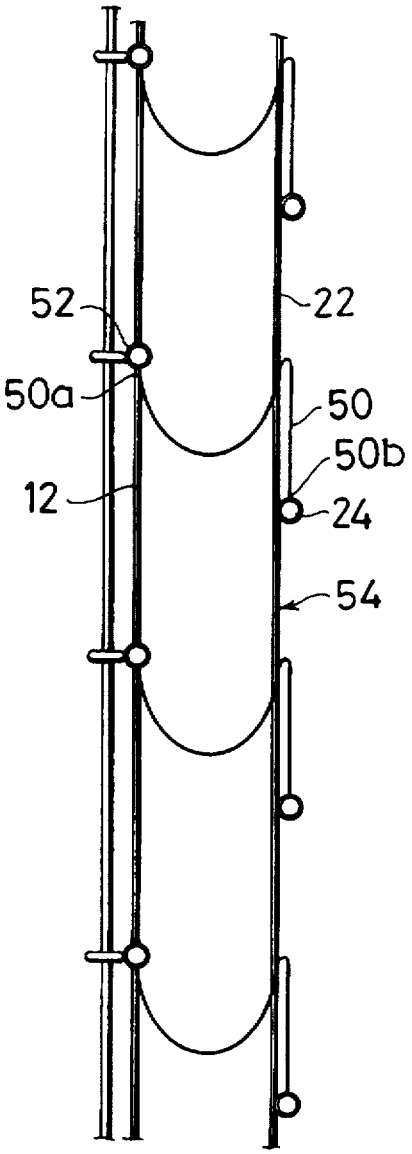

FIGS. 9, 10A, and 10B show a third embodiment of a roman shade according to the present invention. The third embodiment has the same general structure as the first embodiment, exceptions including that the lateral bars 24 are not secured to the opening cords 22. Rather, the opening cords 22 are secured at and through a portion of each front sheet approximately half way along the vertical length of the front sheet 50.

As shown in FIG. 9, the anchor ends 22*a* of the opening cords 22 are displaced from the rear sheet 12. The anchor ends of the opening cords 22 extend through pass-through holes 50*c* formed approximately half way along the vertical length of the front sheets 50. Furthermore, the anchor ends of the opening cords 22 are attached to the front sheets 50 at the pass-through holes 50*c*. Upper lateral bars 52 are attached to the upper end portions 50*a* (attachments) of the front sheets 50, and extend over the full lateral length of the front sheets 50. A curtain box 53 covers the head rail 10.

Figure 11:
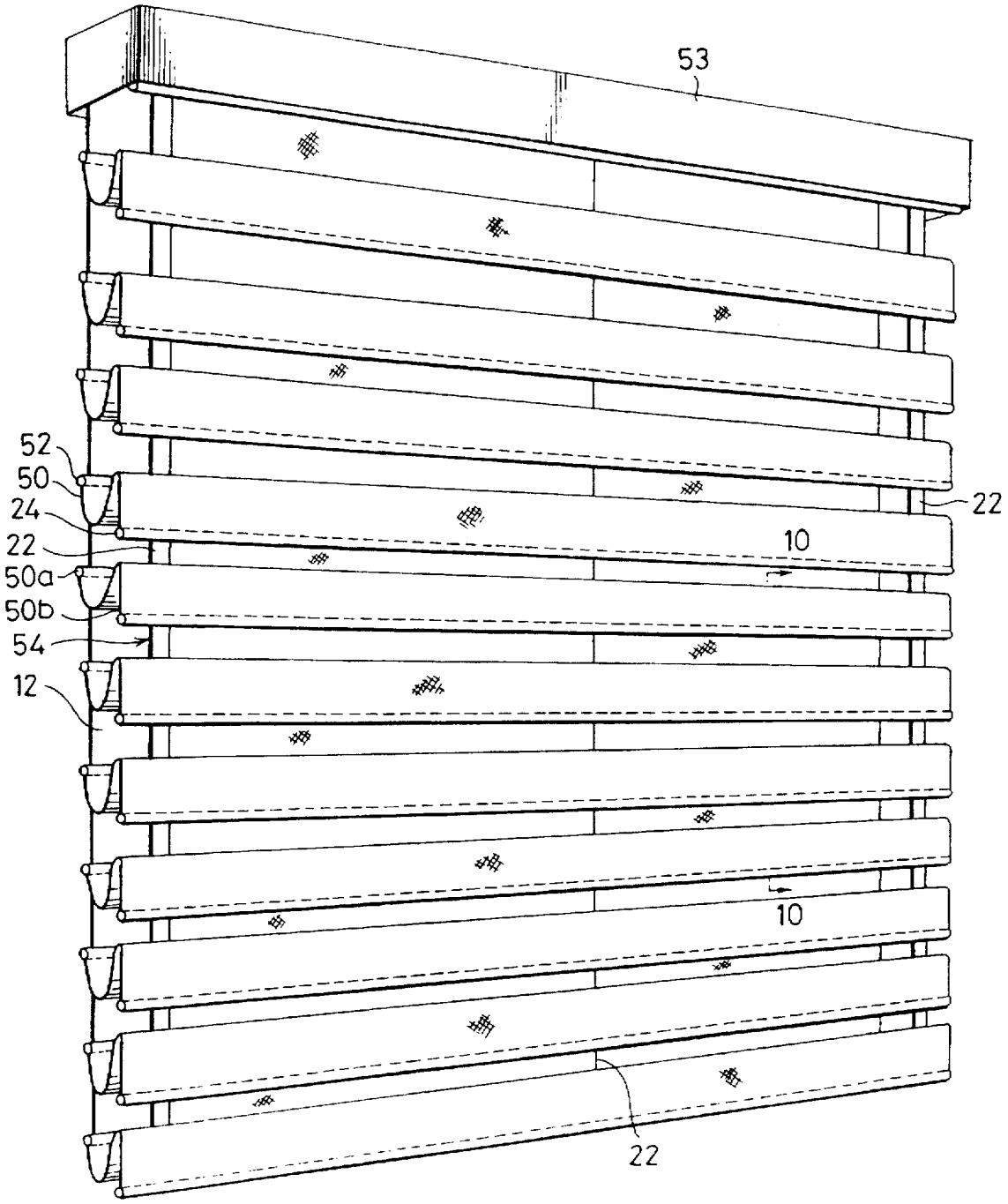
FIG. 11 is a perspective view of the roman shade of FIG. 9, in which front sheets are opened.

In FIGS. 9 and 10A, the front sheets 50 are in the fully closed (lowered) position. In order to open the front sheets 50 from the closed position, the anchor ends 22*a* of the opening cords 22 are drawn up in the same manner as in the first embodiment. As shown in FIGS. 10B and 11, the front sheets 50 are pulled up via their connections at the pass-through holes 50*c*, while the lower end portions 50*b* of the front sheets 50 hang under the weight of the lower lateral bars 24. Openings 54 are formed between the lower end portion 50*b* of each front sheet 50 and the upper end portion 50*a* of the next lower front sheet 50. Accordingly, the rear sheet 12 is exposed via the openings 54. Consequently, the shade can change in appearance, including shape, color, texture, and pattern. Furthermore, when a transparent or semitransparent material is used to form the rear sheet 12, the openings 54 can be viewed through.

In order to close the front sheets 50, the same operation as in the first embodiment is performed, and the shade returns to the state (position) shown in FIGS. 9 and 10A. Furthermore, in the position shown in FIGS. 9 and 10A, since a spacing is created between lower end portions 50*b* of the upper front sheets 50 and the upper end portions 50*a* of the next adjacent front sheets 50, when a rear sheet 12 made of transparent or semitransparent material is used, a room can be indirectly lit via the spacing.

In order to raise the rear sheet 12 (i.e., in order to raise the roman shade), the same operation as in the first embodiment is performed. Accordingly, the raising or lowering of the rear sheet 12 (and the entire shade) can be stopped at any position using the first stopper 10*c*, and the opening and closing of the front sheets 50 can be stopped at any position using the second stopper 10*d*.

Figure 12:
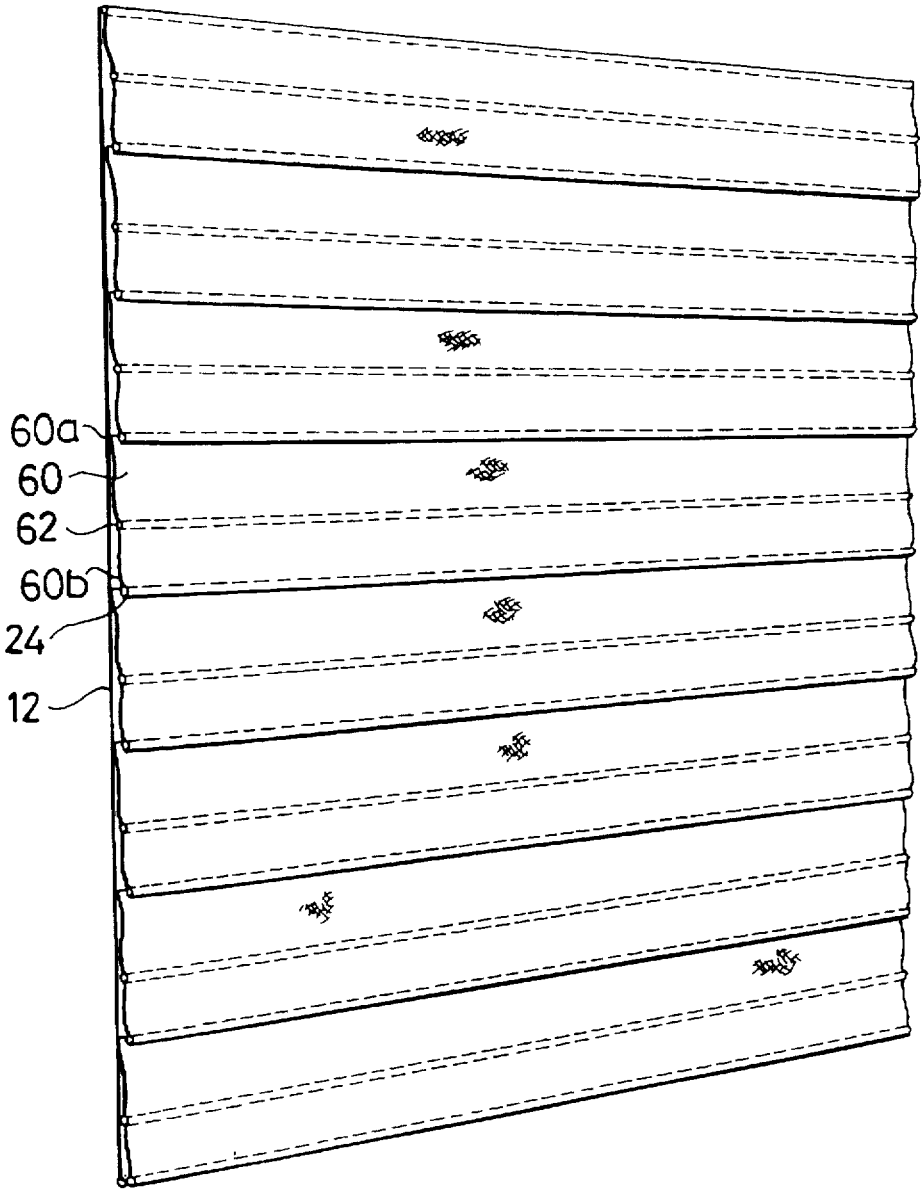
FIG. 12 is a perspective view of a fourth embodiment of a roman shade according to the present invention.

FIG. 12 shows a fourth embodiment of a roman shade according to the present invention. The fourth embodiment has the same general structure as that of the first embodiment, exceptions including that middle lateral bars 62 are provided to the middle portions of the front sheet 60, in addition to lower lateral bars 24 attached to the lower end portions 60*b* of front sheets 60. The middle lateral bars 62 extend over the full lateral length of the front sheets 60, and are attached approximately midway (in the vertical direction) between the upper end portions (i.e., the attachment to the rear sheet 12) and the lower end portions of the front sheets.

Figure 13:
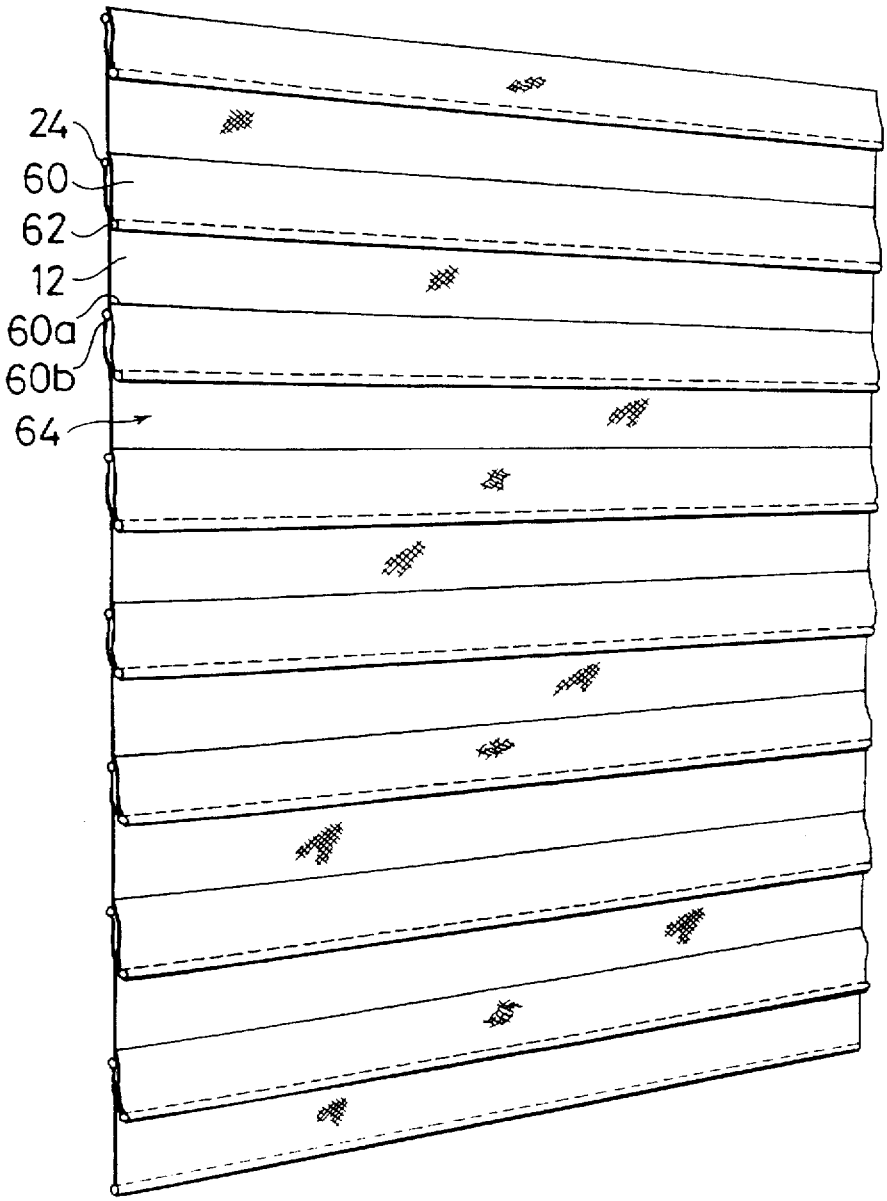
FIG. 13 is a perspective view of the roman shade of FIG. 12, in which front sheets are opened.

FIG. 12 shows the fully closed condition of the front sheets 60 of the fourth embodiment. To open the front sheets 60 from the state (position) shown in FIG. 12, the anchor ends 22*a* of the opening cords 22 are drawn up (similarly to the first embodiment), pulling up the lower end portions 60*b* of the front sheet 60. As shown in FIG. 13, since each front sheet 60 is provided with a middle lateral bar 62 approximately midway along the vertical direction, the middle lateral bar 62 acts as a weight, and each front sheet 60 tends to fold at the vertical position of the corresponding middle lateral bar 62. Furthermore, since each middle lateral bar 62 acts as a weight, the portion of the front sheet 60 attached to the middle lateral bar 62 tends to become the lowermost portion of the front sheet 60. Accordingly, the folds in the front sheet 60 form a well-defined linear shape, and openings 64 are formed between the middle lateral bar 62 of each front sheet 60 and the upper end portion 60*a* of the next lower front sheet 60. When the front sheets 60 are opened in this manner, the rear sheet 12 is exposed through the openings 64. Consequently, the shade can change in appearance, including shape, color, texture, and pattern. Furthermore, when a transparent or semitransparent material is used to form the rear sheet 12, the openings 64 can be viewed through.

In order to close (i.e., lower) the opened front sheets 60, the same operation as in the first embodiment is performed, and the front sheets 60 return to the state shown in FIG. 12. In order to raise the rear sheet 12 (i.e., in order to raise the roman shade), the same operation as in the first embodiment is performed. Accordingly, the raising or lowering of the rear sheet 12 (and the entire shade) can be stopped at any position using the first stopper 10*c*, and the opening and closing of the front sheets 60 can be stopped at any position using the second stopper 10*d*.

Figure 14:
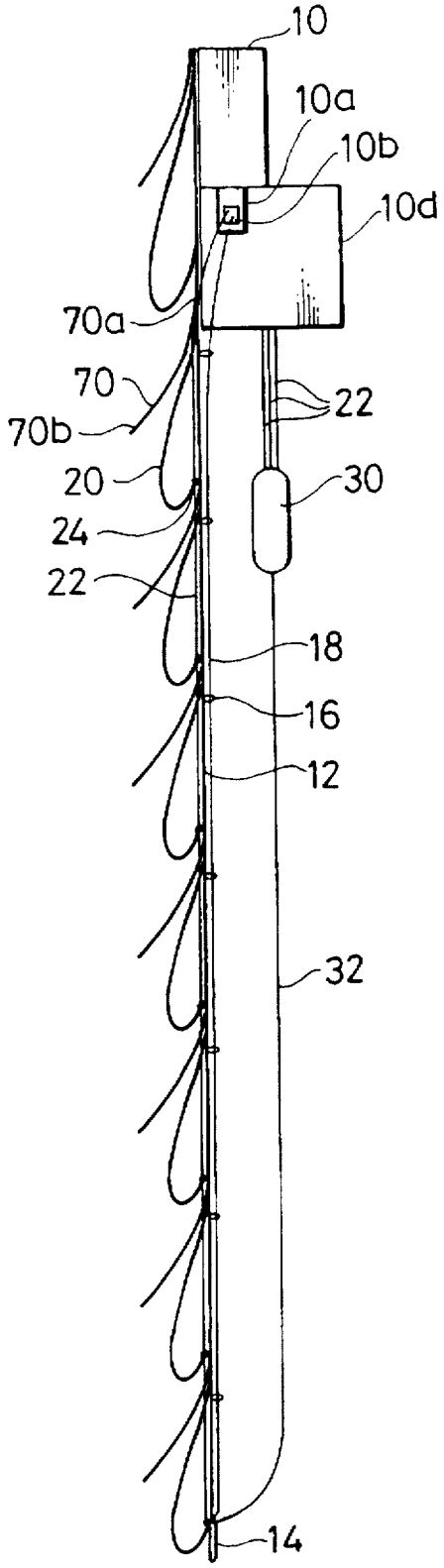
FIG. 14 is a side view of a fifth embodiment of a roman shade according to the present invention.

FIG. 14 shows a fifth embodiment of a roman shade according to the present invention. The fifth embodiment has the same general structure as that of the first embodiment, exceptions including that upper end portions 20*a* of the front sheets 20 (i.e., the attachments to the rear sheet 12) are connected to upper portions 70*a* of corresponding valance cloths 70. The corresponding valance cloths 70 are also attached to the rear sheet 12, and each valance cloth hangs down to a position approximately midway between the upper end portion 20*a* and lower end portion 20*b* of the corresponding front sheet 20.

FIG. 14 shows a fully closed (i.e., lowered) position of the front sheets 20 of the fifth embodiment. In order to open (i.e., raise) the front sheets 20 from the positions shown in FIG. 14, the same operations as in the first embodiment are performed. That is, the lower end portions 20*b* of the front sheets 20 are drawn up via the opening cords 18, forming large, loose folds therein. However, in the fifth embodiment, since the valance cloths 70 remain hanging down in front of the front sheets 20, the front sheets 20 are screened by the valance cloths 70.

Figure 15:
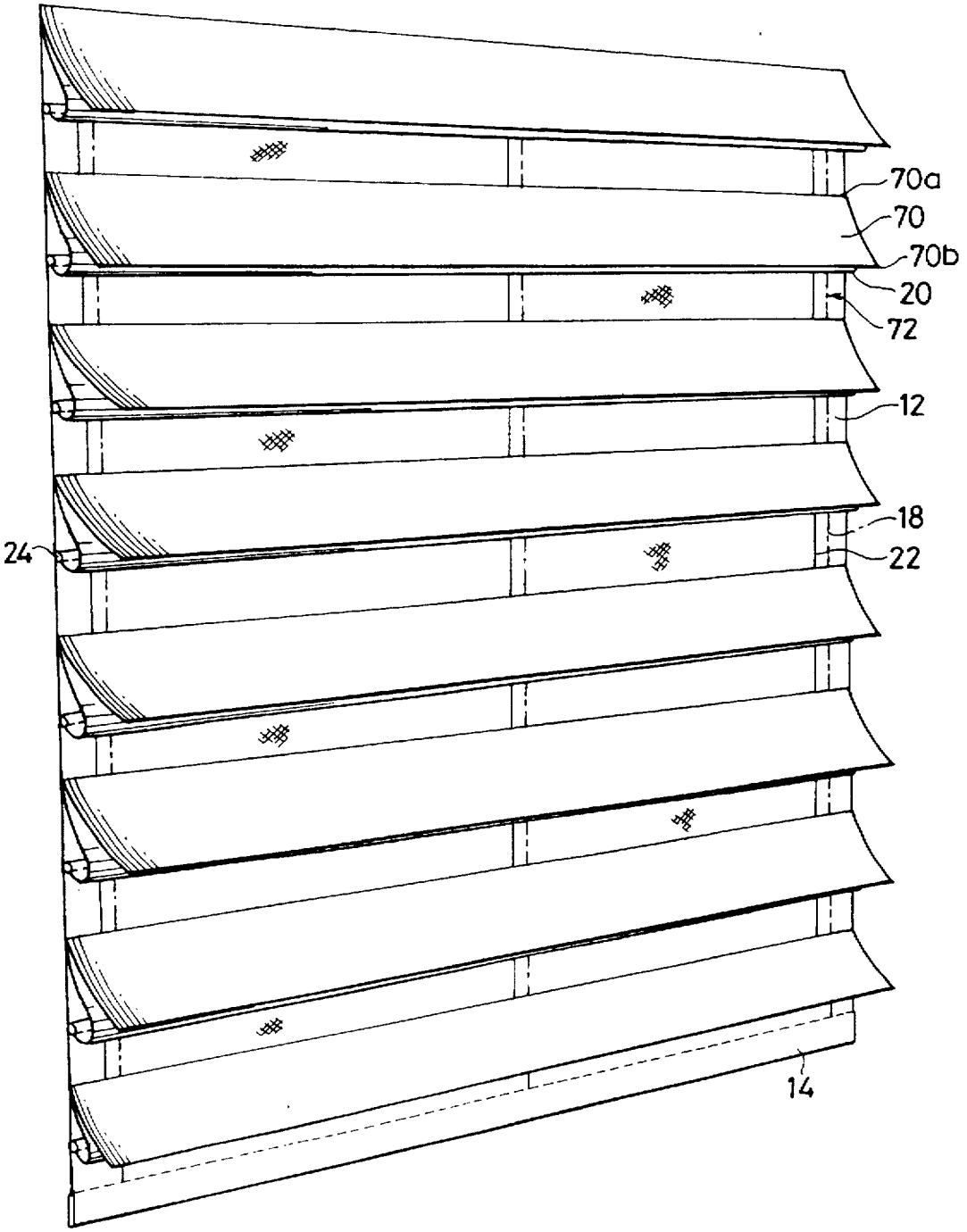
FIG. 15 is a perspective view of the roman shade of FIG. 14, in which front sheets are opened.
Figure 16:
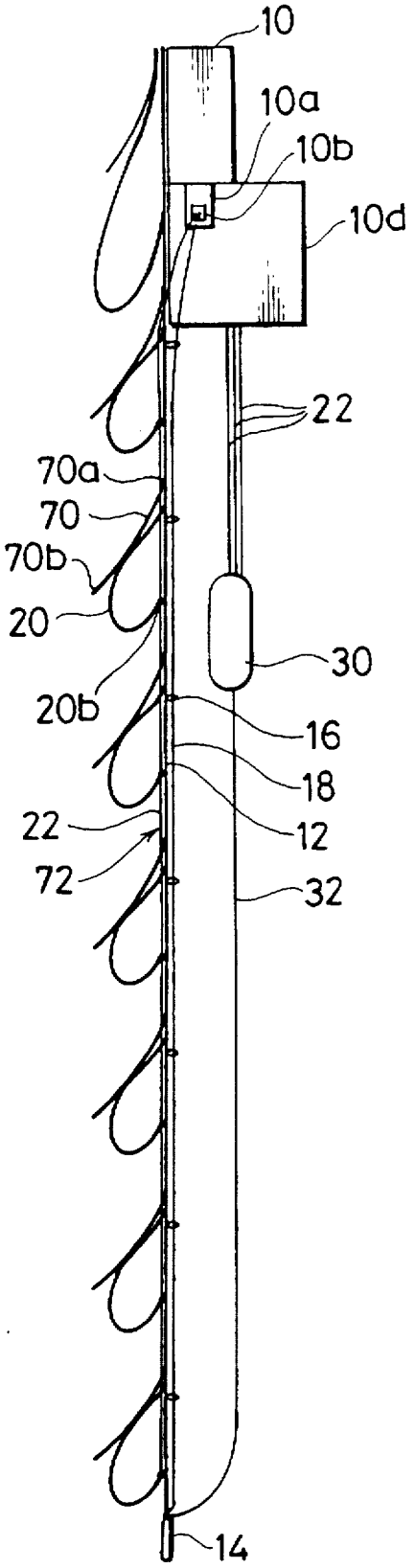
FIG. 16 is a side view of the roman shade of FIG. 14, in which front sheets are opened.

As shown in FIG. 14, 15, and 16, since each valance cloth 70 extends only midway between the upper end portion 20*a* and lower end portion 20*b* of the corresponding front sheet 20, openings 72 are formed between the lower end portion 70*b* of each valance cloth 70 and the upper end portions 70*a* of the next lower valance cloth 70. In this manner, the rear sheet 12 is exposed through the opening 72, and the shade can change in appearance, including shape, color, texture, and pattern. Furthermore, when a transparent or semitransparent material is used to form the rear sheet 12, the openings 72 can be viewed through.

In order to close (i.e., lower) the front sheets 20, the same operation as in the first embodiment is performed, returning the front sheets 20 to the state shown in FIG. 14. In order to raise the rear sheet 12 (i.e., in order to raise the roman shade), the same operation as in the first embodiment is performed. Accordingly, the raising or lowering of the rear sheet 12 (and the entire shade) can be stopped at any position using the first stopper 10*c*, and the opening and closing of the front sheets 20 can be stopped at any position using the second stopper 10*d*.

Figure 17:
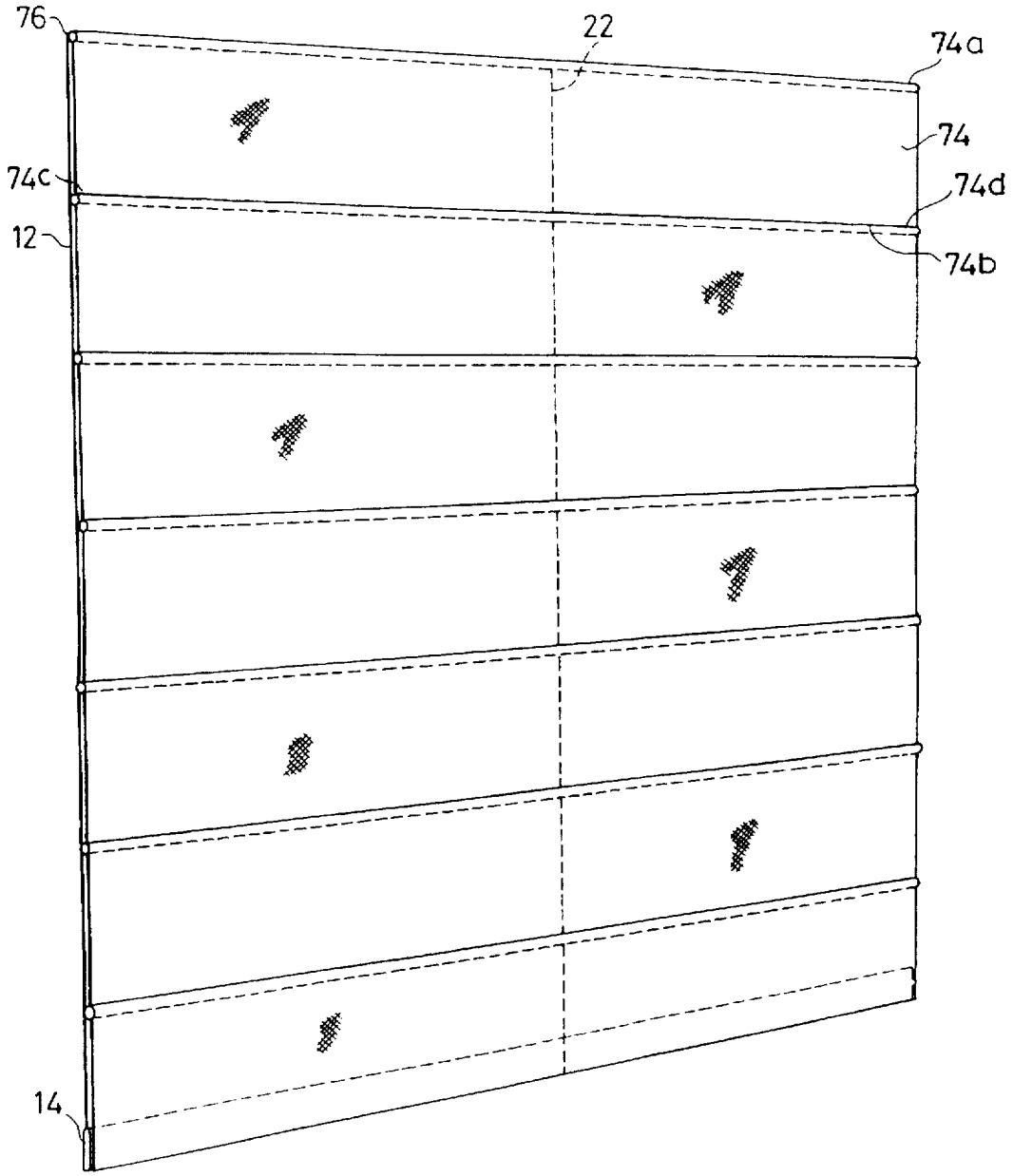
FIG. 17 is a perspective view of a sixth embodiment of a roman shade according to the present invention, in which front sheets are closed.
Figure 18:
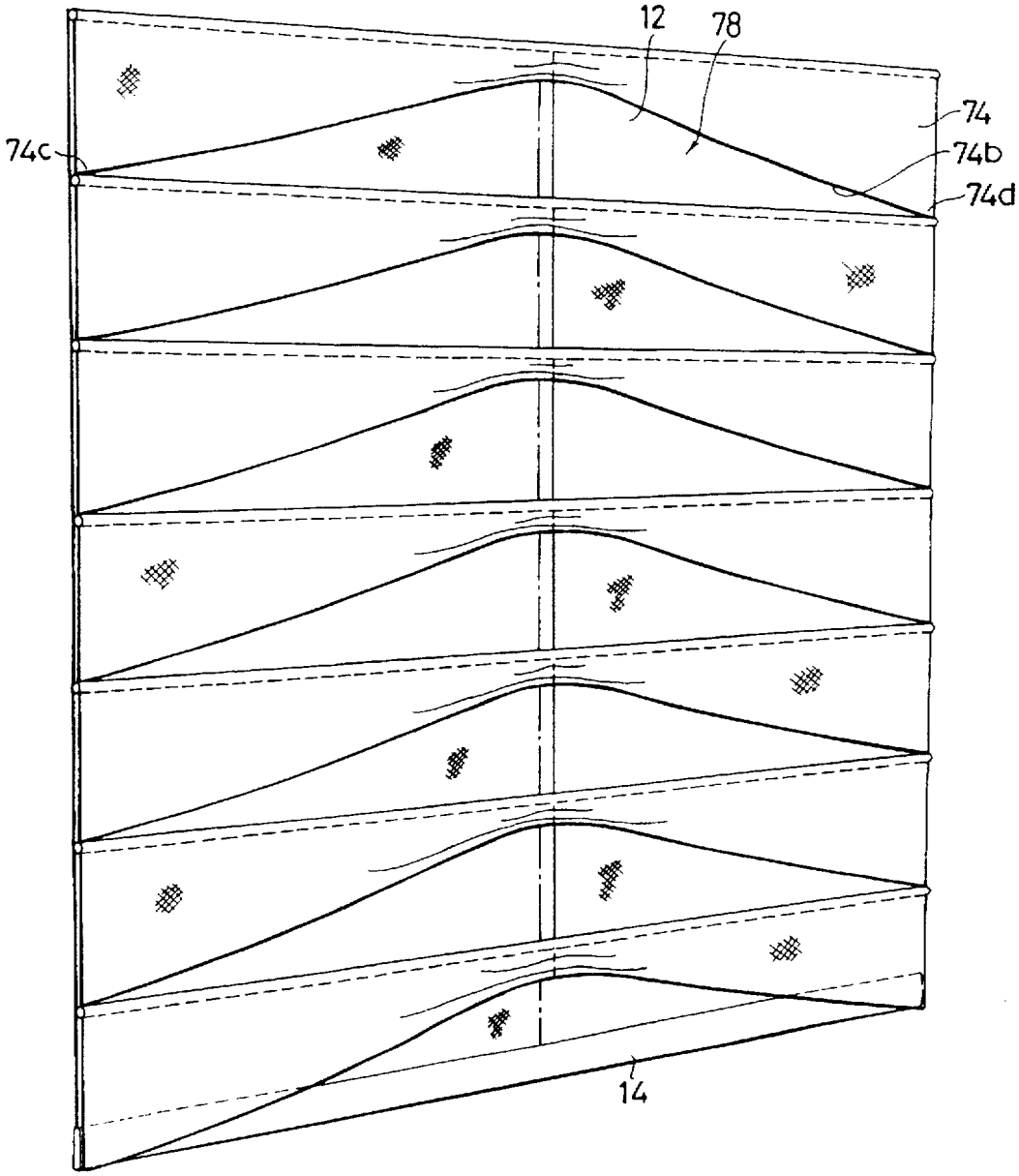
FIG. 18 is a perspective view of the roman shade of FIG. 17, in which front sheets are opened.

FIG. 17 shows a sixth embodiment of a roman shade according to the present invention. The sixth embodiment has the same general structure as the first embodiment, exceptions including that the front sheets 74 are formed from an expandable material, and that upper lateral bars 76 are provided at upper end portions 74*a* of the front sheets 74. The upper lateral bars 76 extend over the full lateral length of the front sheets 74. Still further, left and right lower corners of 70*c* and 70*d* of each of the front sheets 74 are connected to the rear sheet 12. Preferably, only one opening cord 22 is provided in the middle position of the front sheets 74 in the lateral direction. With this structure, the middle portion of each front sheets 74 may be drawn up while leaving the left and right end portions of the front sheets 74 in a lower position.

FIG. 17 shows a fully closed position of the front sheets 74 of the sixth embodiment. In order to open (i.e., raise) the front sheets 74 of the sixth embodiment from the state shown in FIG. 17, the same general operation as in the first embodiment is performed. However, in this case, both lower corners 74*c* and 74*d* of the front sheet 74 remain connected to the rear sheet 12. Since the rear sheet 12 is made of expandable material, the lower end portions 74*b* of the front sheets 74 are raised up in the center thereof, stretching the front sheets 74 and forming triangular openings 78 having an apex in the middle of front sheets 74 in the lateral direction. In this manner, the triangular openings 78 are formed between a lower end portion 74*b* of each front sheet 74 and the upper portion of the next lower front sheet 74. Accordingly, the rear sheet 12 is exposed through the triangular openings 78, and the shade can change in appearance, including shape, color, texture, and pattern. When using a rear sheet 12 made of transparent or semitransparent material, a viewer can see through the triangular openings 78.

When closing (i.e., lowering) the front sheets 74, the same operation as in the first embodiment is performed in order to return the front sheets 74 to the stage shown in FIG. 17. When raising the rear sheet 12 (i.e., raising the shade), the same operation as in the first embodiment is performed. Accordingly, the raising or lowering of the rear sheet 12 (and the entire shade) can be stopped at any position using the first stopper 10*c*, and the opening and closing of the front sheets 74 can be stopped at any position using the second stopper 10*d*.

Although both side end portions 74*c* and 74*d* and the lower end portions 74*b* of the front sheets 74 are connected to the rear sheet 12, the roman shade according to the sixth embodiment may be constructed with an alternative structure wherein the lower lateral corners (side end portions 74*c* and 74*d*) are not connected to the rear sheet 12. The expandable material may be of any kind, including resilient, pleated, or having concertina folds. Furthermore, although the front sheets 74 are preferably made of an expandable material, the material of the front sheet 74 is not necessarily restricted to an expandable type. Still further, although upper lateral bars 76 are attached to upper end portions 74*a* of the front sheets 74, the upper end portions 74*a* of the front sheets may alternatively be attached directly to the rear sheet 12.

Figure 19:
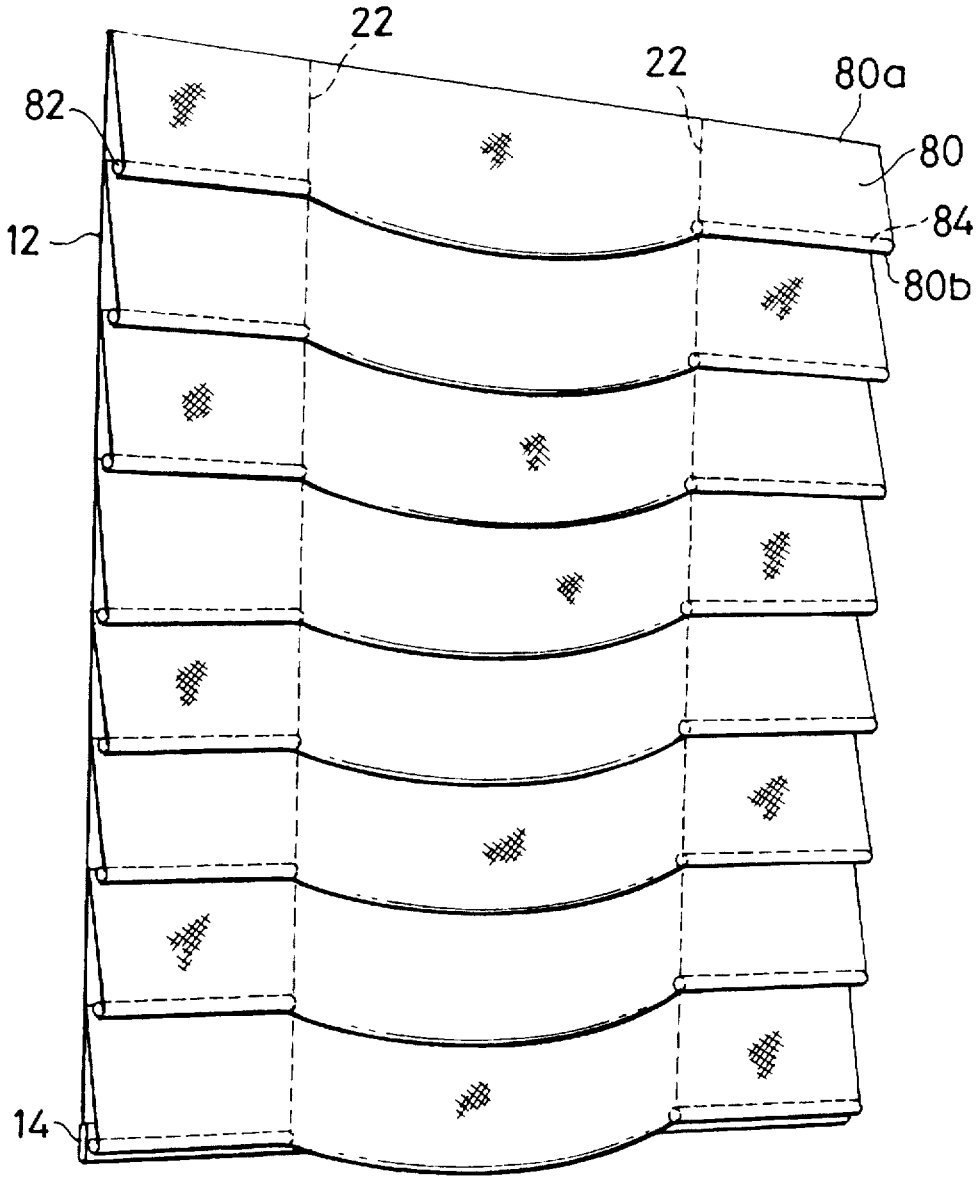
FIG. 19 is a perspective view of a seventh embodiment of a roman shade according to the present invention, in which front sheets are closed.

FIG. 19 shows a seventh embodiment of a roman shade according to the present invention. As shown in FIG. 19, the seventh embodiment has the same general structure as the first embodiment, exceptions including that left and right lateral bars 82 and 84 are attached to left and right lower end portions 80*b* of front sheets 80. The left and right lateral bars 82 and 84 each extend laterally from respective left and right edges toward the center of a corresponding front sheet 80, leaving a draping central portion. The inner ends of the left and right lateral bars 82 and 84 are connected to opening cords 22 as shown in FIG. 19. Each central portion drapes down by the virtue of the empty weight of the corresponding front sheet 80.

Figure 20:
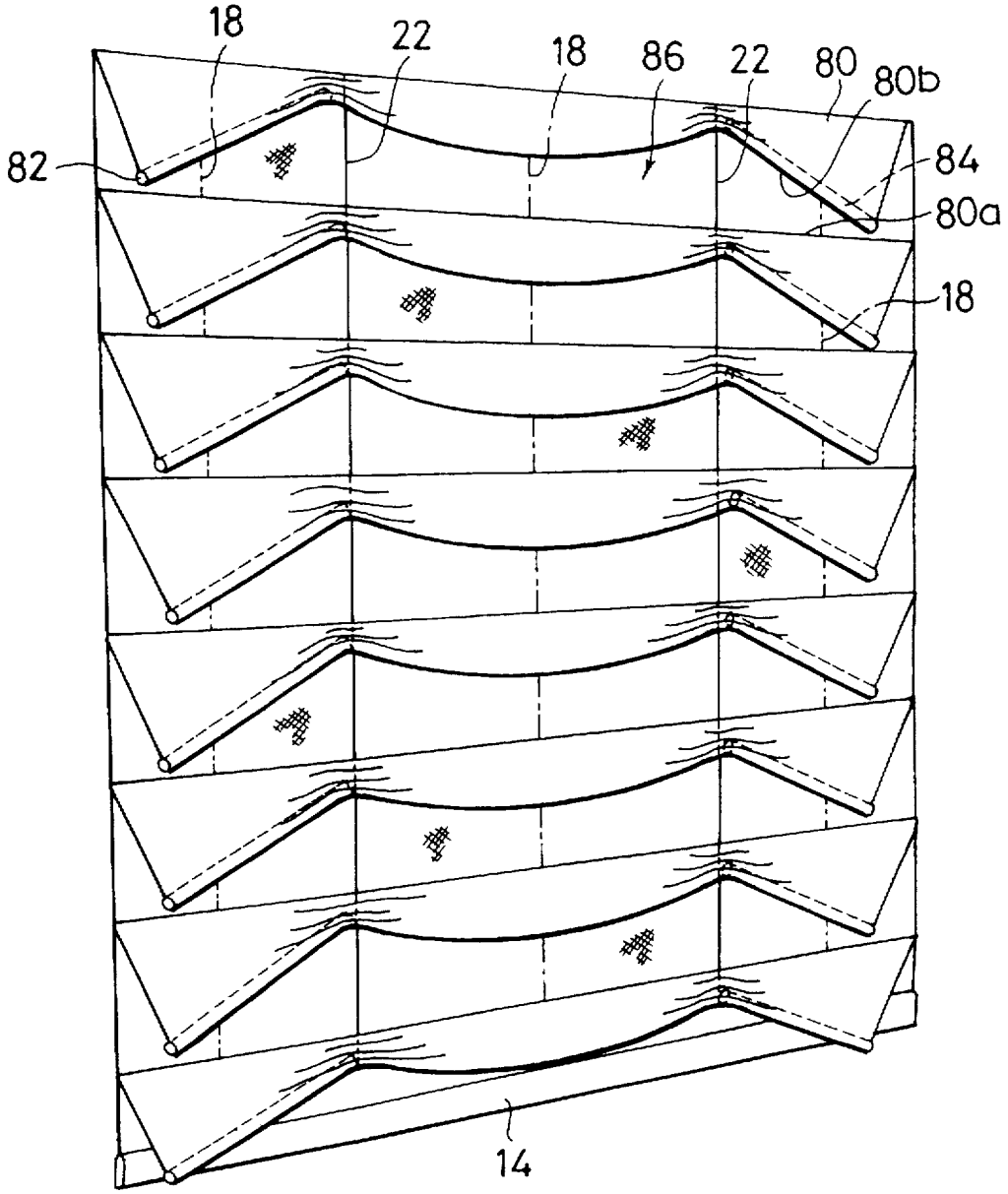
FIG. 20 is a perspective view of the roman shade of FIG. 19, in which front sheets are raised.

FIG. 19 shows the closed state of the front sheets 80. In order to open the front sheets 80, the same operation as in the first embodiment is performed. Anchor ends of the opening cords 22 are attached to the inner ends of left and right lateral bars 82 and 84, and when the anchor ends of the opening cords 22 are drawn up, the left and right lateral bars 82 and 84 incline upward. The left and right portions of the corresponding front sheets 80 follow and incline linearly upward. As shown in FIG. 20, the front sheets 80, unattached to the left and right lateral bars 82 and 84 in the middle region, form hanging portions in the center of the front sheets 80. More particularly, the left and right portions of the front sheets 80, attached to and supported by the left and right lateral bars 82 and 84, form inclined straight edges as the front sheets are pulled up by the opening cords 22, while the unattached middle portions form curved (draping) portions when pulled up by the opening cords 22. In this manner, an opening 86 having a draped shape, including both straight lines and curves, is formed between the lower end portion 80*b* of each front sheet 80 and the upper end portion 80*a* of the next lower front sheet 80, and between a lower end portion 80*b* of the lowermost front sheet 80 and the ballast bar 14. The rear sheet 12 is exposed through the openings 86. Accordingly, the shade can change in appearance, including shape, color, texture, and pattern. When using a rear sheet 12 made of transparent or semitransparent material, a viewer can see through the triangular openings 86.

When closing (i.e., lowering) the front sheets 80, the same operation as in the first embodiment is performed in order to return the front sheets 86 to the stage shown in FIG. 19. When raising the rear sheet 12 (i.e., raising the shade), the same operation as in the first embodiment is performed. Accordingly, the raising or lowering of the rear sheet 12 (and the entire shade) can be stopped at any position using the first stopper 10*c*, and the opening and closing of the front sheets 80 can be stopped at any position using the second stopper 10*d*.

Figure 21:
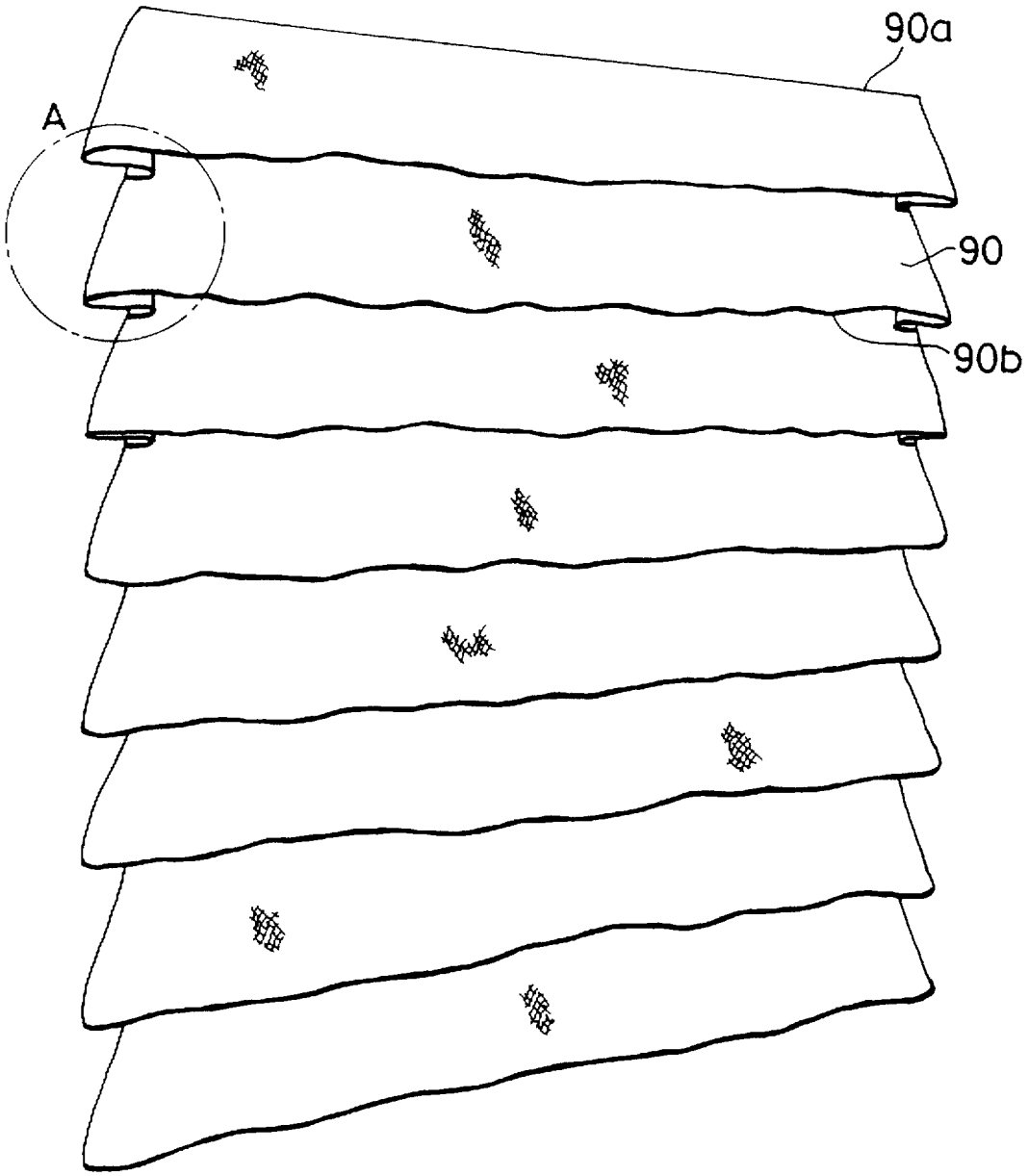
FIG. 21 is a perspective view of an eighth embodiment of a roman shade according to the present invention, in which front sheets are closed.
Figure 22:
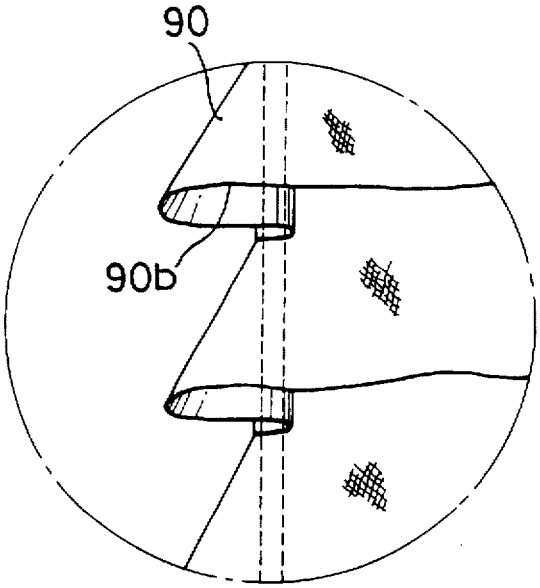
FIG. 22 is an enlarged detail of Part A of FIG. 21.

FIG. 21 shows an eighth embodiment of a roman shade according to the present invention. As shown in FIG. 21, the eighth embodiment has the same general structure as the seventh embodiment, exceptions including that lateral bars are not provided toward lower end portions 90*b* of the front sheets 90, and that both side end portions of each front sheet 90 are sewn to both side end portions of the rear sheet 12. Furthermore, as shown in FIG. 22, each sewn side end portion of each front sheet 90 includes a slack portion 90*d* where the side end portion is sewn to the rear sheet 12. Preferably, the opening cords 22 are attached to the front sheets 90 only at central portions thereof. More particularly, a plurality of opening cords 22 are preferably attached to the front sheets 90 within a range of laterally central positions away from the side end portions, with lateral spacing therebetween.

Figure 23:
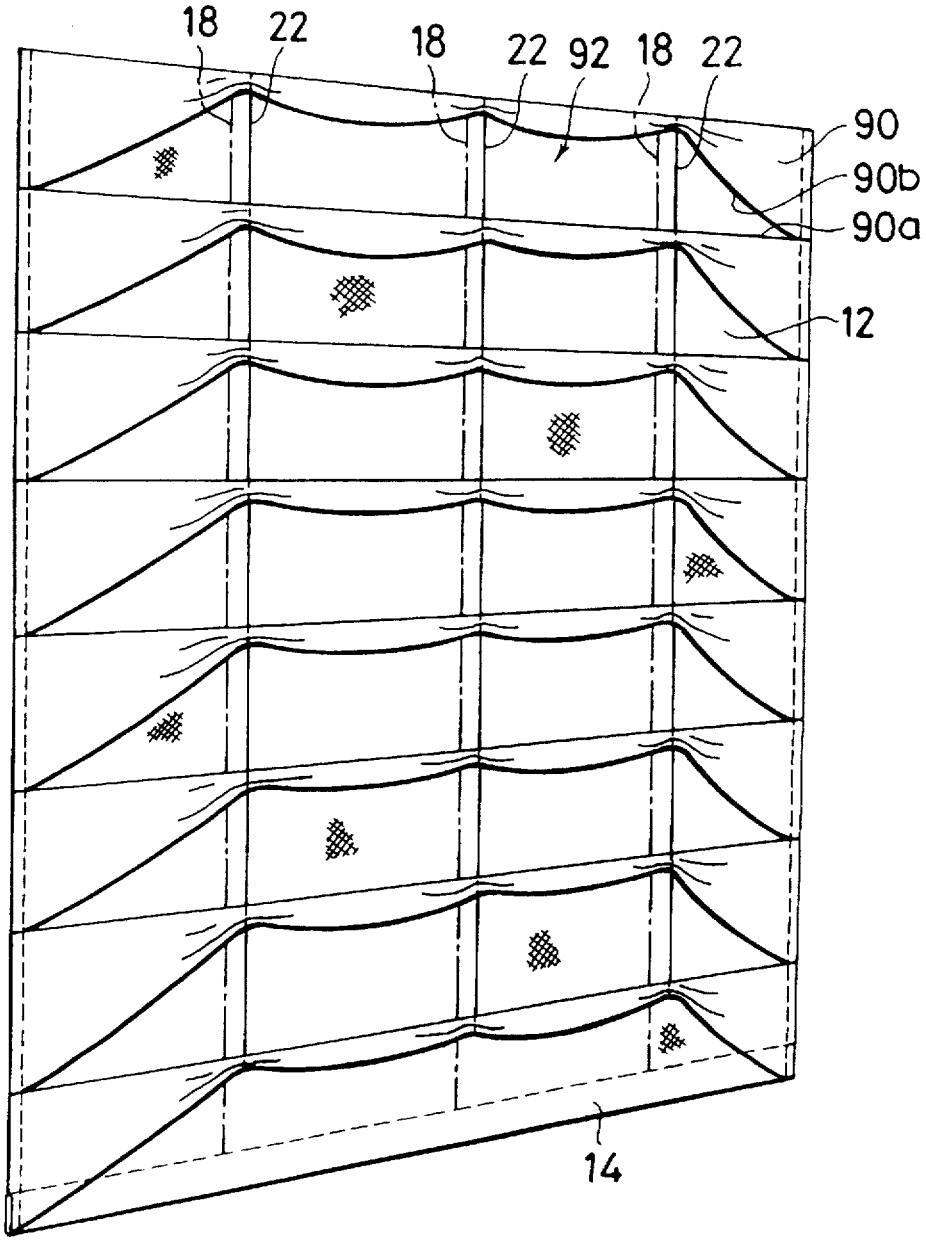
FIG. 23 is a perspective view of the roman shade of FIG. 21, in which front sheets are raised.

FIG. 21 shows the eighth embodiment of the present invention of a roman shade with the front sheets 90 in a closed (i.e., lowered) position. In order to open the front sheets 90 of the roman shade of the eighth embodiment, the same general action as in the seventh embodiment is taken. That is, as the anchor ends of the opening cords 22 are drawn up to open the front sheets 90. As shown in FIG. 23, since the opening cords 22 are attached to the front sheets 90 only at the central portions thereof, and the front sheets 90 are sewn at the edges of the rear sheet 12, large draped openings 92 are formed. Each draped opening 92 is bounded at the top edge by wavy draping portions of the corresponding front sheet 92. The slack portions 90*d* at the edges of each of the front sheets 90 are taken up by the opening action. A draped opening 92 is formed between a lower end portion 90*b* of each front sheet 90 and an upper end portion 90*a* of the next lower front sheet 90, and between a lower end portion 90*b* of the lowermost front sheet 90 and the ballast bar 14. In this manner, the rear sheet 12 is exposed through the draped openings 92, and the shade can change in appearance, including shape, color, texture, and pattern. Furthermore, when a transparent or semitransparent material is used to form the rear sheet 12, a view is obtained through the openings 92.

In order to close (i.e., lower) the front sheets 20, the same operation as in the first embodiment is performed, returning the front sheets 20 to the state shown in FIG. 23. In order to raise the rear sheet 12 (i.e., in order to raise the roman shade), the same operation as in the first embodiment is performed. Accordingly, the raising or lowering of the rear sheet 12 (and the entire shade) can be stopped at any position using the first stopper 10*c*, and the opening and closing of the front sheets 90 can be stopped at any position using the second stopper 10*d*.

Figure 24:
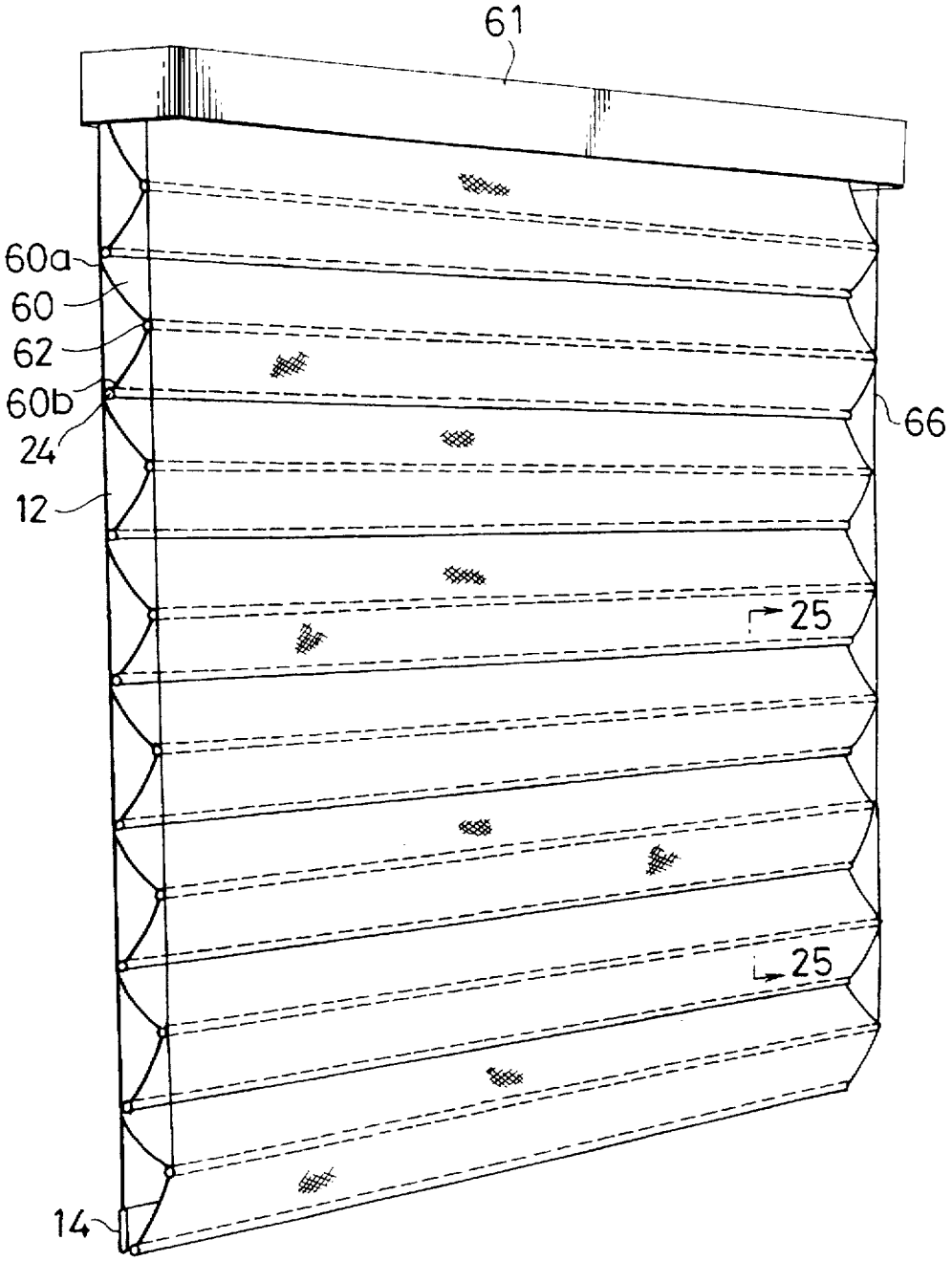
FIG. 24 is a perspective view with a ninth embodiment of a roman shade according to the present invention, in which front sheets are closed.
Figure 25:
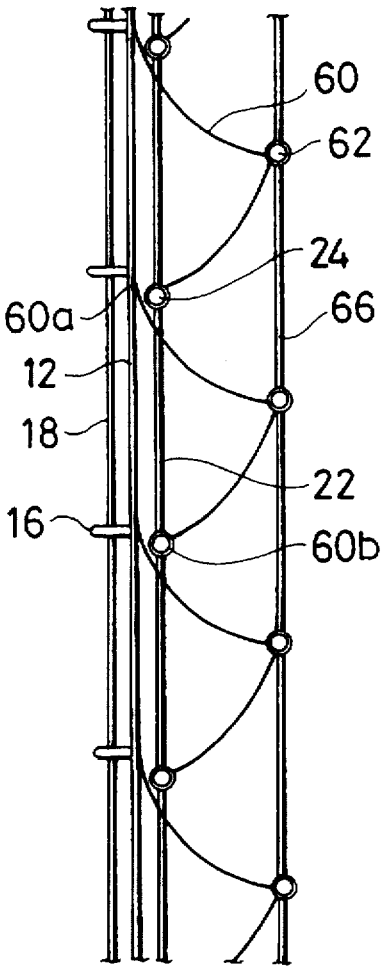
FIGS. 25A and 25B are sectional side views taken along line XXV—XXV of FIG. 24, showing different positions of the shade.
Figure 25:
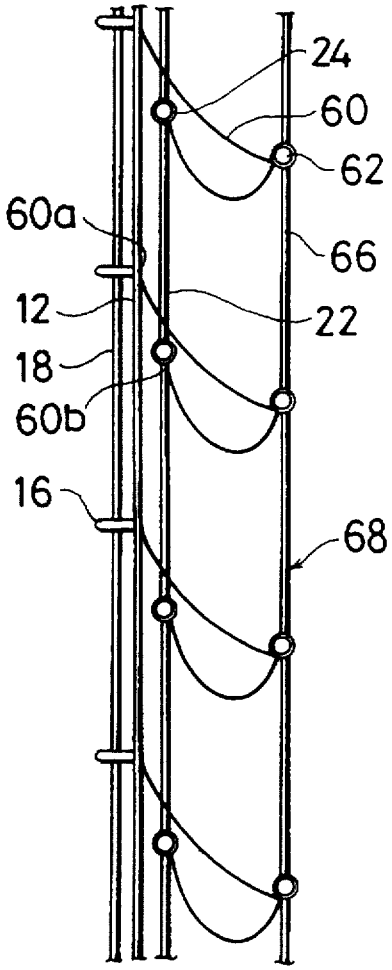

FIGS. 24, 25A, and 25B show a ninth embodiment of a roman shade according to the present invention. As shown in FIGS. 24, 25A and 25B, the ninth embodiment has the same general structure as the fourth embodiment, exceptions including that a spacer 66 (spacer cords) hangs from the head rail 10 displaced from the rear sheet 12, and the central lateral bars 62 attached to the front sheets 60 are suspended from the spacer cords 66. The spacer cord 66 are displaced from the rear sheet 12 by a predetermined spacing, and a curtain box 61 covers the head rail 10.

Using this spacing structure, since the central lateral bar 62 forms the front sheets 60 into a protruding triangular shape, as seen from the side of the shade, the shade has variety in shape from both the side and the front, that is, variety in three dimensions.

FIGS. 24 and 25A show the closed state of the front sheets 60 of the ninth embodiment. In order to open the front sheets 60 of the ninth embodiment, as shown in FIG. 25B, the anchor ends 22*a* of the opening cords 22 are drawn up in the same manner as in the first embodiment, pulling up the lower lateral bars 24. However, since each central lateral bar 62 of a corresponding front sheet 60 is connected to the spacer cord 66, only the lower end portions 60*b* of the front sheet 60 (below the central lateral bar 62) can be raised with the lower lateral bars 24. When the lower end portions 60*b* of the front sheets 60 are raised as shown in FIG. 25B, the central lateral bars 62 remain suspended in the same positions by the spacer cords 66. Accordingly, the opening area can be improved (increased) in comparison to the case where the spacer cord 66 is not connected to a suspended central lateral bar 62. In this manner, as the rear sheet 12 is exposed through the opening 68, the shade can change in appearance, including shape, color, texture, and pattern. Furthermore, when a transparent or semitransparent material is used to form the rear sheet 12, a view is obtained through the openings 68.

In order to close (i.e., lower) the front sheets 60, the same operation as in the first embodiment is performed, returning the front sheets 60 to the state shown in FIGS. 24 and 25A. In order to raise the rear sheet 12 (i.e., in order to raise the roman shade), the same operation as in the first embodiment is performed. Accordingly, the raising or lowering of the rear sheet 12 (and the entire shade) can be stopped at any position using the first stopper 10*c*, and the opening and closing of the front sheets 60 can be stopped at any position using the second stopper 10*d*.

Figure 26:
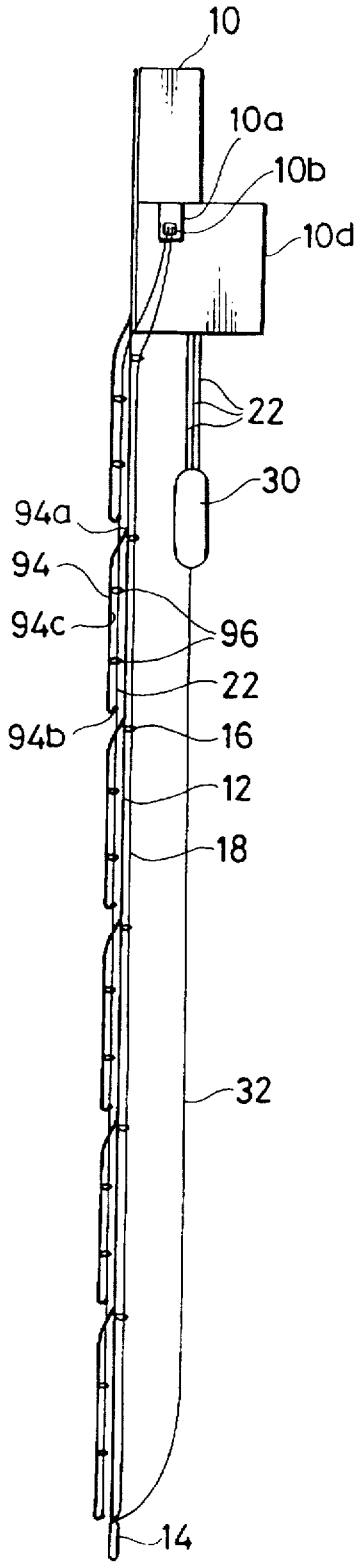
FIG. 26 is a side view of a tenth embodiment of a roman shade according to the present invention, in which front sheets are closed.

FIG. 26 shows a tenth embodiment of a roman shade according to the present invention. As shown in FIG. 26, the tenth embodiment has a similar general structure to the first embodiment, exceptions including that each of the front sheets 94 is provided with two pass-through rings 96 for each opening cord 22. The pass-through rings 96 are vertically distributed at intervals along the rear surfaces 94*c* of each front sheet 94, and act to compress opened front sheets 94 into small folds.

Figure 27:
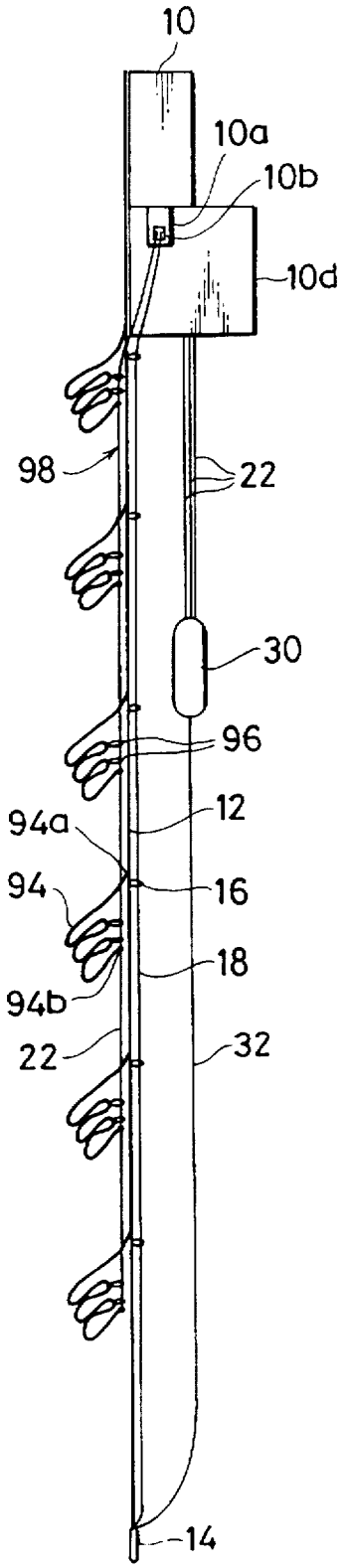
FIG. 27 is a side view of the roman shade of FIG. 26, in which front sheets are open.

FIG. 26 shows the closed state of the front sheets 94 of the tenth embodiment. In order to open the front sheets 94 from the stage shown in FIG. 26, the same actions as in the first embodiment are taken. That is, the anchor ends 22*a* of opening cords 22 are drawn up, and the lower end portions 94*b* of the front sheets 94 are thereby raised. However, in this case, the pass-through rings 96 serve to successively fold each front sheet 94 into multiple (in this case, three) small folds. That is, as the lower end portion 94*b* of each front sheet 94 is brought into contact with the lower corresponding pass-through ring 96, the lower pass-through ring 96 is moved up together with the lower end portion 94*b*, folding a portion of the corresponding front sheet 94. Then, as shown in FIG. 27, as the lower pass-through rings 96 are brought into contact with the upper pass-through rings 96, the lower end portion 94*b* and the two pass-through rings 96 are raised together. In this manner, the front sheets compress as they fold up, and larger openings 98 are formed between the lower end portion 94*b* of each front sheet 94 and an upper end portion 94*a* of the next lower front sheet 94, and between the lower end portion 94*b* of the lowermost front sheet 94 and the ballast bar 14. This opening 98 is larger than that formed where the pass-through rings 96 are not used. Accordingly, as the rear sheet 12 is exposed through the openings 98, the shade can change in appearance, including shape, color, texture, and pattern. In the tenth embodiment, the openings 98 are especially large. Furthermore, when a transparent or semitransparent material is used to form the rear sheet 12, a view is obtained through the openings 98.

In order to close (i.e., lower) the front sheets 94, the same operation as in the first embodiment is performed, returning the front sheets 94 to the state shown in FIG. 26. In order to raise the rear sheet 12 (i.e., in order to raise the roman shade), the same operation as in the first embodiment is performed. Accordingly, the raising or lowering of the rear sheet 12 (and the entire shade) can be stopped at any position using the first stopper 10*c*, and the opening and closing of the front sheets 94 can be stopped at any position using the second stopper 10*d*.

Figure 28:
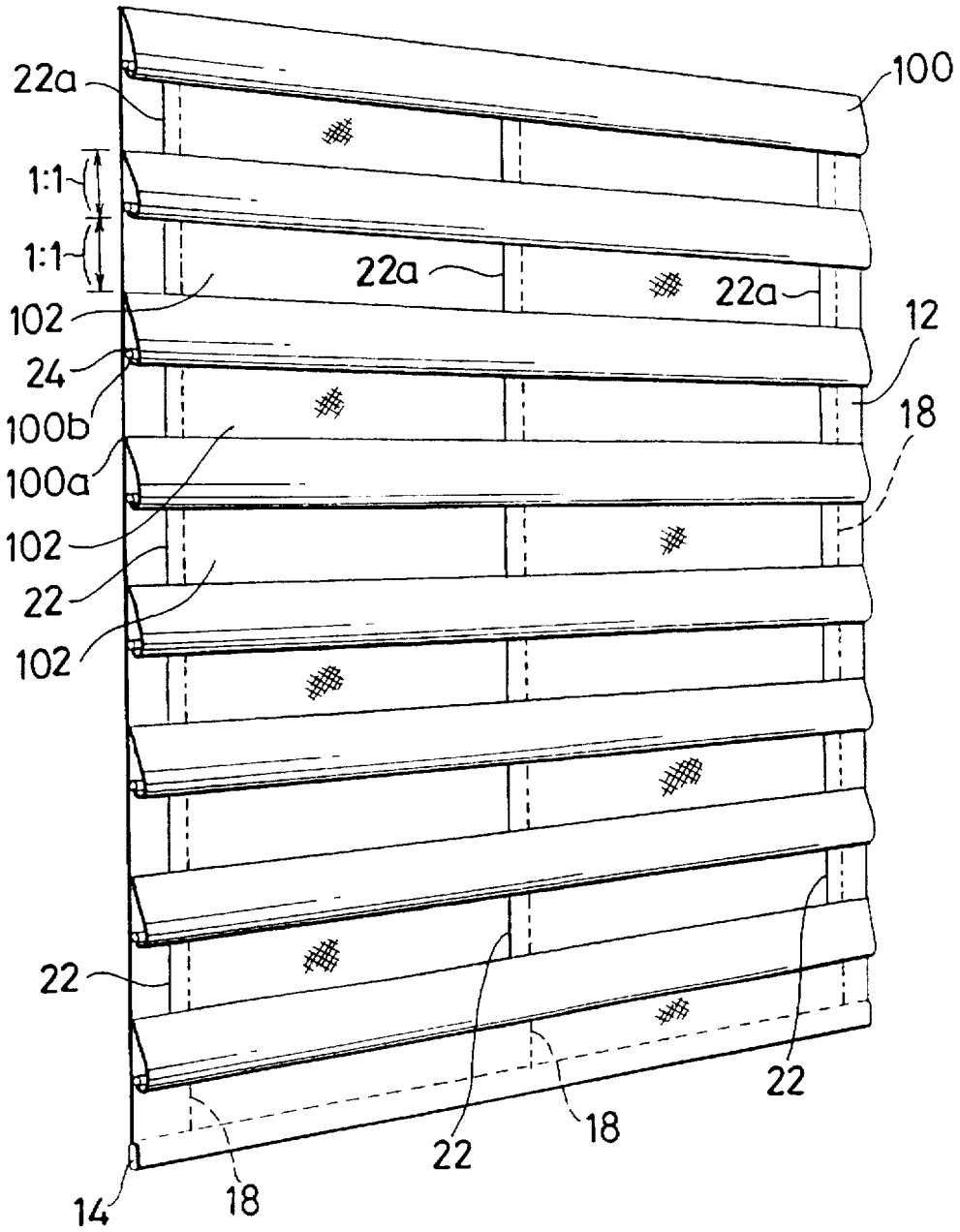
FIG. 28 is a perspective view of an eleventh embodiment of a roman shade according to the present invention, in which front sheets are closed.

FIG. 28 shows an eleventh embodiment of a roman shade according to the present invention. As shown in FIG. 28, the eleventh embodiment has the same general structure as the first embodiment, exceptions including that the front sheets 100 do not extend vertically across the full separation between successive front sheets 100. Accordingly, in the stage where the front sheets 100 have been fully lowered, the lateral bar 24 provided at the lower end portion 100*b* of each front sheet 100 remains separated from the next lower front sheet 100. The openings 102 between the front sheets 100 are variable in size, but are always open to some degree. An opening 102 is formed between the lower end portion of each upper front sheet 100 and the upper end portion 10*a* of the next lower front sheet 100, and between the lower end portion of the lowermost front sheet 100 and the ballast bar 14. In this fashion, the rear sheet 12 is always exposed through the openings 102.

FIG. 28 shows the fully lowered condition of the front sheets 100 of the eleventh embodiment. As shown in FIG. 28, in the eleventh embodiment, the vertical length of each front sheet 100 is approximately half of the length of the front sheet in the first embodiment and approximately half of the vertical distance between successive front sheets 100. The opening amount of the fully lowered front sheets 100 (i.e., the size of the openings 102) in the eleventh embodiment is approximately half the length of the distance between front sheets 100.

In order to open (i.e., raise) the front sheets 100 of the eleventh embodiment, the same actions as in the first embodiment are taken. That is, as the anchor ends 22*a* are drawn up, the front sheets 100 are opened. However, since the openings 102 are always present, when raising the front sheets 100 from the stage shown in FIG. 28, the openings 102 become wider.

Figure 29:
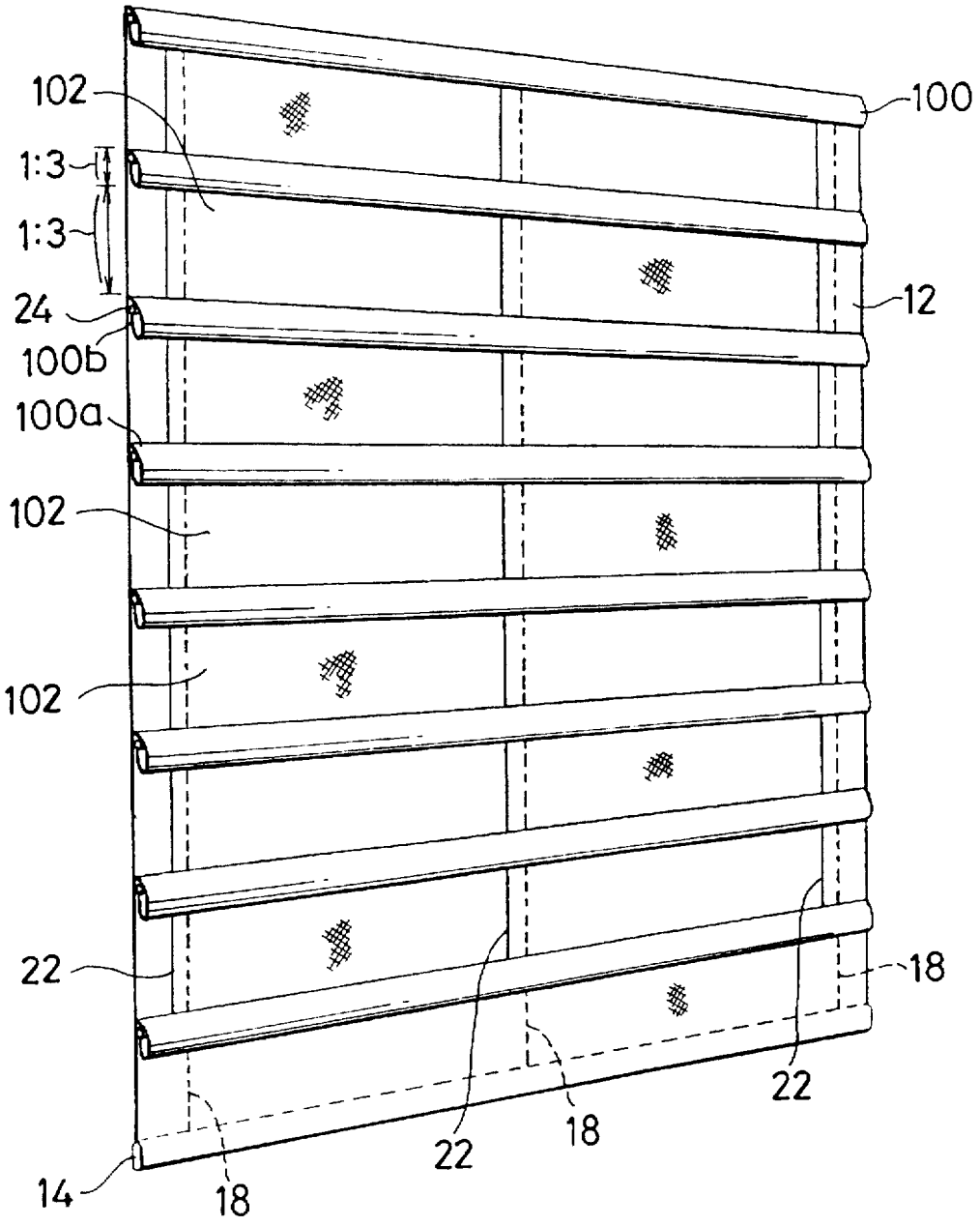
FIG. 29 is a perspective view of the roman shade of FIG. 28, in which front sheets are open.

As the front sheets 100 are fully raised to the position shown in FIG. 29, the lateral bars 24 are brought into contact to the upper end portions 10*a* of the front sheets 100, and the lateral bars 24 are thereby restrained from being raised any further. As shown in FIG. 29, the vertical length of each front sheet 100 becomes one half of that shown in FIG. 28. Therefore, the size of the openings 102 is increased to approximately three fourths the length of the vertical distance between the front sheets 100, and the rear sheet 12 is exposed to a larger extent than that of the fully closable front sheet of the first embodiment. Accordingly, the shade can change in appearance, including shape, color, texture, and pattern. Furthermore, when a transparent or semitransparent material is used to form the rear sheet 12, a view is obtained through the openings 98. Although a screening function is not possible with the eleventh embodiment, the regulation of the quantity of light admitted through the openings 102 is possible. That is, the roman shade of the eleventh embodiment can be used to regulate the amount of light admitted therethrough.

In order to close (i.e., lower) the sheets 100, the same operation as in the first embodiment is performed, returning the front sheets 100 to the state shown in FIG. 28. In order to raise the rear sheet 12 (i.e., in order to raise the roman shade), the same operation as in the first embodiment is performed. Accordingly, the raising or lowering of the rear sheet 12 (and the entire shade) can be stopped at any position using the first stopper 10*c*, and the opening and closing of the front sheets 100 can be stopped at any position using the second stopper 10*d*.

Figure 30:
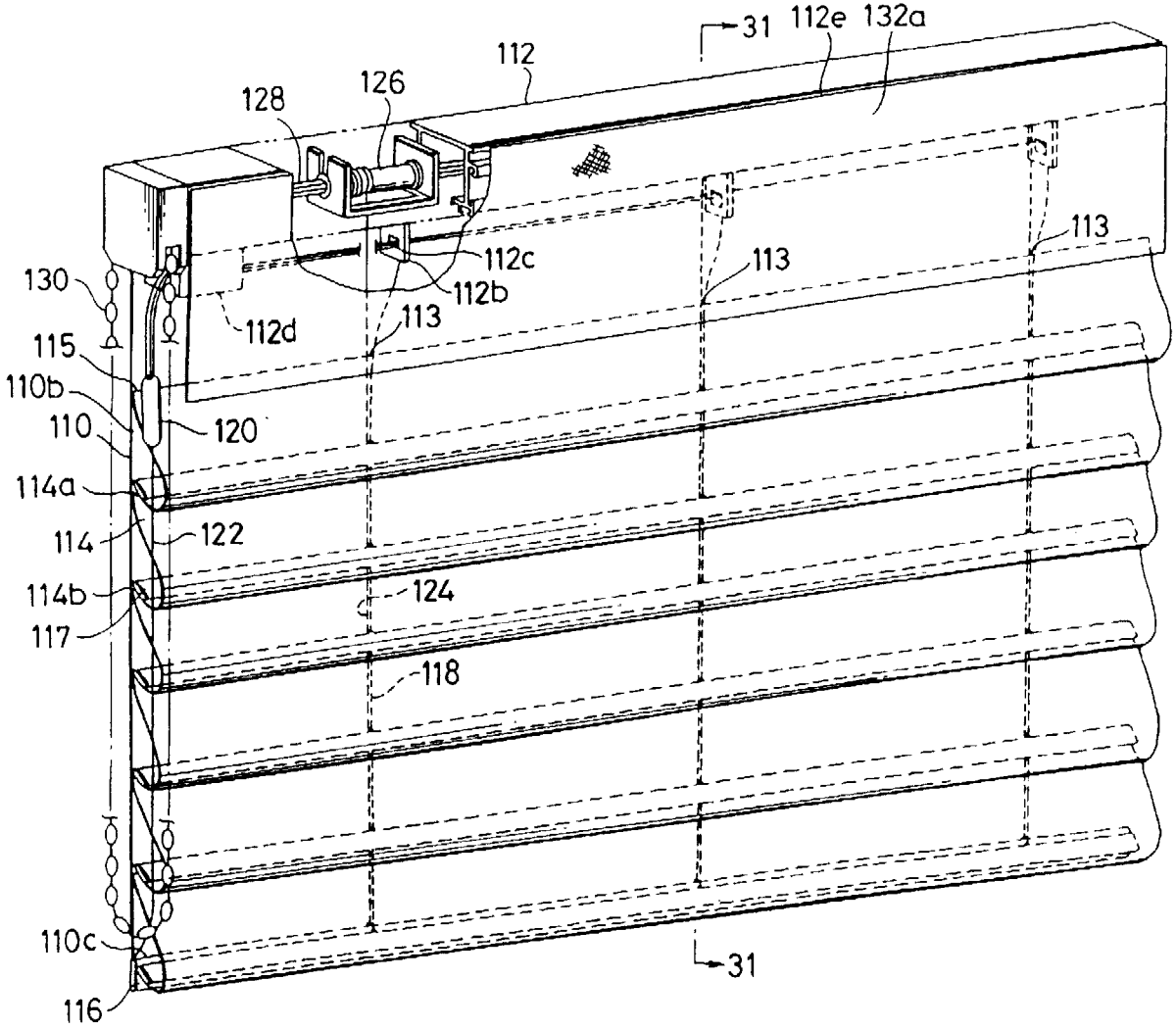
FIG. 30 is a partially cutaway perspective view of a twelfth embodiment of a roman shade according to the present invention.
Figure 31:
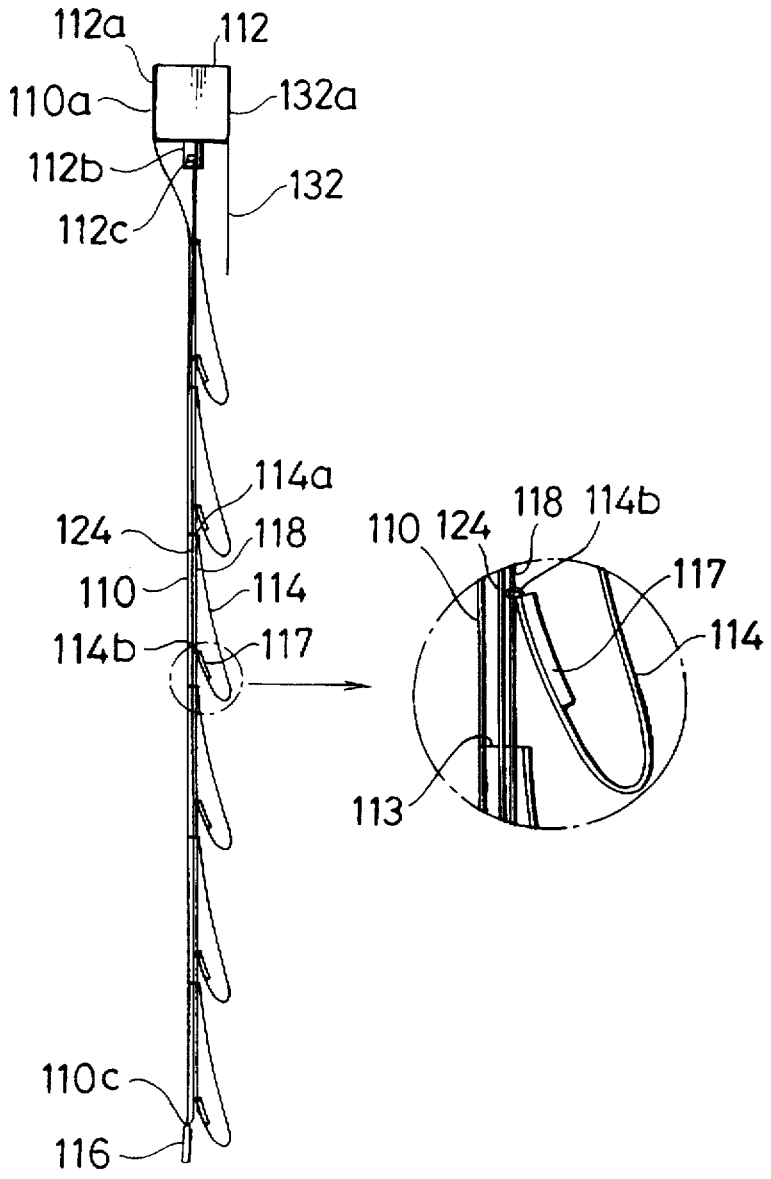
FIG. 31 is a sectional view taken along line XXXI—XXXI of FIG. 30.

FIGS. 30 and 31 show a twelfth embodiment of a roman shade according to the present invention. In the twelfth embodiment, upper ends 114*a* (attachments) of a plurality of front sheets 114 are attached at predetermined vertical intervals to a rear sheet 110 hanging from a head rail 112. The upper ends 114*a* of the front sheets 114 are attached to the front face 110*b* of the rear sheet 110. The rear sheet 110 hangs via its upper end 110*a* from a rear portion 112*a* of a head rail 112. The lower end 110*c* of the rear sheet 110 is attached to a ballast bar 116.

As shown in FIG. 31, the attachments at upper ends 114*a* of the front sheets 114 to the rear sheet 110 are formed with insertion extensions 113, through which opening cords 118 and raising cords 124 can be passed. The insertion extensions 113 are provided at equal intervals in the lateral direction at three places along the lateral length of each front sheet 114.

The inner surfaces of the lower ends 114*b* of each individual front sheet 114 are connected to shaping plates 117 extending over the full lateral length of each individual front sheet 114. The shaping plates 117 shape the lower end of the fold of each opened front sheet 114 to a rectangular shape. Anchor ends of the opening cords 118 extend from the head rail 112 in the vertical direction, and are connected to each of the front sheets 114. The opening cords 118 are passed through the insertion extensions 113 between the upper portion of each front sheets 114 and the rear sheet 110. The opening cords 118 are further passed through pass-through holes 112*c* of cord guides 112*b* at the lower side of the head rail 112, and through a stopper 112*d* positioned at the left end (in FIG. 32) of the head rail 112. Pulling ends of the opening cords 118 extend beyond the head rail 112. The pulling ends of the opening cords 118 are then connected to an opening grip 120. An opening return cord is connected to the lower portion of the opening grip 120, and the opening return cord extends to connect to the ballast bar 116. Accordingly, the opening cords 118 can be pulled in upward or downward directions.

Anchor ends of the raising cords 124 extend from the lower portion of the head rail 112, are passed through the insertion extensions 113 between the rear sheet 110 and the upper portions of the front sheets 114, and are connected to the ballast bar 116. Furthermore, pulling ends of the raising cords 124 are wound on a drum 126 (or plurality of drums 126, only one drum 126 being shown). The drum 126 is mounted within the head rail 112, and is rotatable via a rotation axis 128 at the center of the drum 126. The rotation axis 128 is rotatably supported within the head rail 112. A left end portion of the rotation axis 128 (as shown in FIG. 30) is connected to a pulley (not shown) and is rotatable together with the pulley. A ball-chain 130 is wound about the pulley and engaged thereto, so that the pulley is driven in forward or reverse directions by operating the ball-chain 130.

An upper end 132*a* of a valance cloth 132 is connected to a front side 112*e* of the head rail 112. The valance cloth 132 hangs from the head rail 112, and extends midway between the upper end portion and lower end portion of the uppermost front sheet 114.

Figure 32:
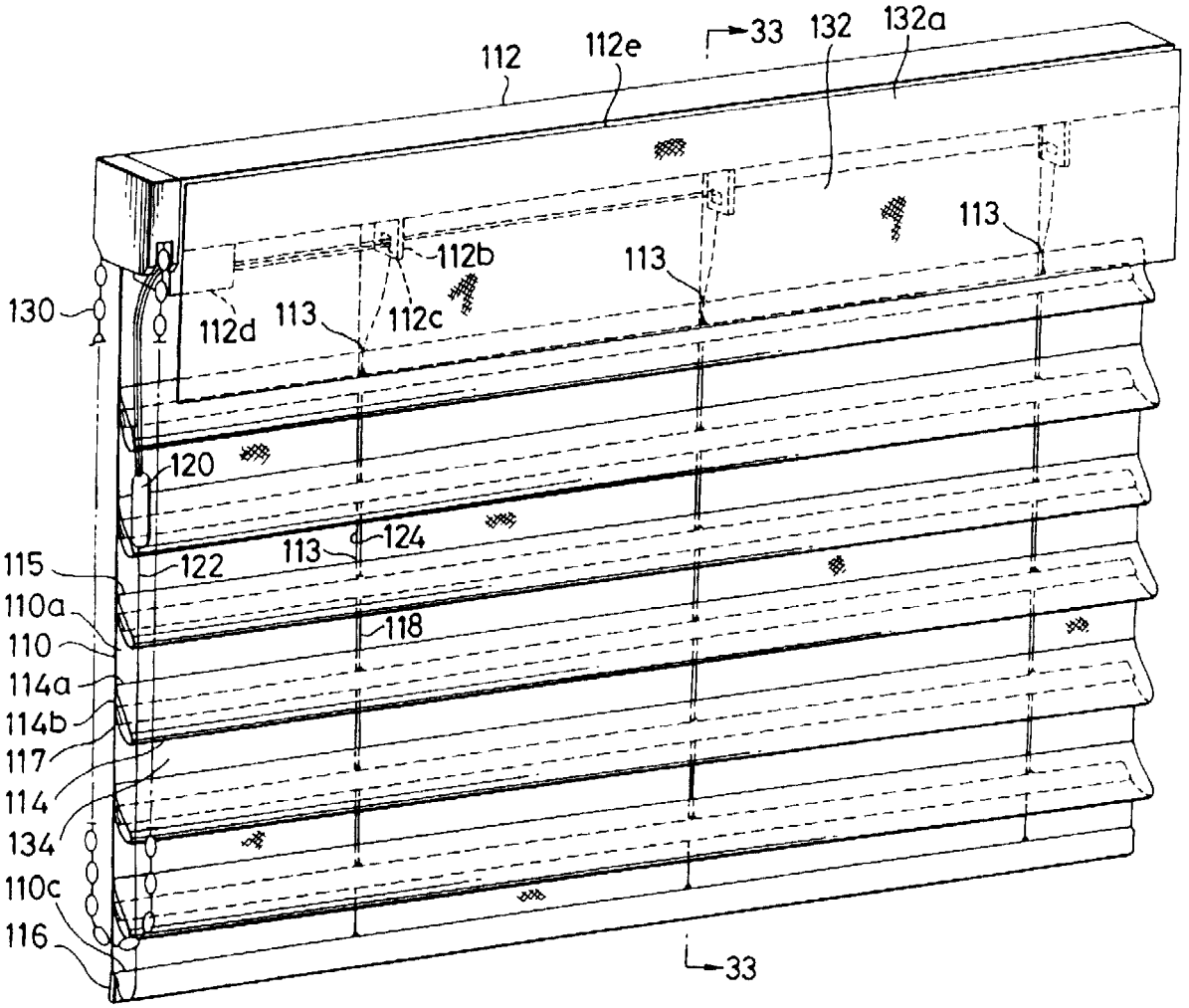
FIG. 32 is a perspective view of a twelfth embodiment of a roman shade according to the present invention, in which front sheets are open.
Figure 33:
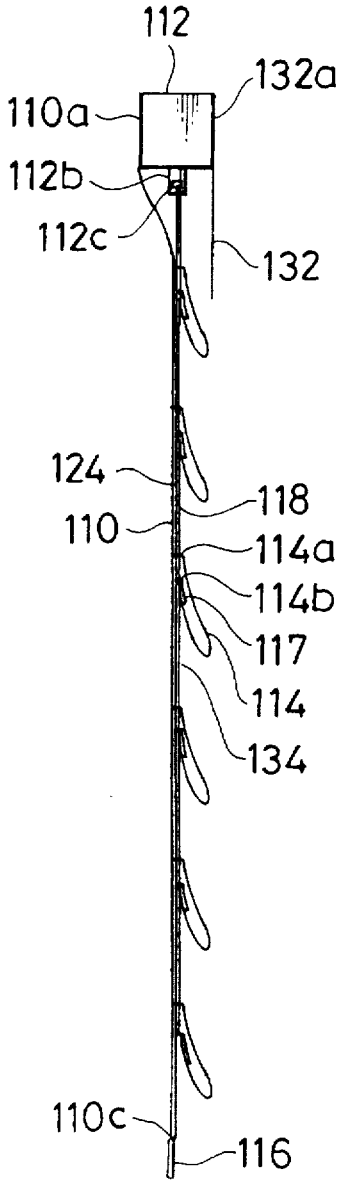
FIG. 33 is a sectional view taken along line XXXIII—XXXIII of FIG. 32.

FIG. 30 shows the closed position of the front sheets 114 of the twelfth embodiment. In order to open the front sheets 114 from the position shown in FIG. 30, the opening grip 120 (or the opening cord 118 itself) is pulled down, drawing up the anchor ends of the opening cords 118. As shown in FIGS. 32 and 33, the lower ends 114*b* of each front sheet 114 are raised, forming a linear sharp fold over the entire lateral width of each front sheets 114. As shown in FIG. 30–34, the shaping plates 117 shape the first front sheets 114 as they are drawn up, i.e., the linear sharp folds follow influence of the shaping plates 117, forming rectangular openings 134 between the sharp fold in each front sheet 114 and the upper end portion 114*a* of the next lower front sheet 114, and between the sharp fold in the lowermost front sheet 114 and the ballast bar 116. The shaping plates 117 are substantially rectangular, and each extends across the width of the corresponding front sheet 114. Each shaping plate 117 is formed from a material that is stiffer (in combination with the front sheet 114 to which it is attached) than the remainder of the corresponding front sheet 117, so that the shaping plates 117 may shape the front sheets 114 as they are drawn up. In this manner, the rear sheet 110 is exposed through the rectangular openings 134. Furthermore, the front sheets 114 can be held in open and closed positions (or any position in between) by fastening the stopper 112*d* to restrain the opening cords 118 from moving. Accordingly, the shade can change in appearance, including shape, color, texture, and pattern. Furthermore, when using a rear sheet 110 formed from a semitransparent material, a view can be obtained through the rear sheet 110 as seen through the openings 134. Still further, the quantity of light admitted through the rear sheet 110 can be finely controlled by controlling the extent to which the front sheets 114 are drawn up, and the amount of light admitted can be regulated thereby.

In order to close the front sheets 114, the opening cords 118 are moved, using the opening grip 120 or the opening cords 118 themselves, to release the stopper 112*d*, and allowing the opening cords 118 to move vertically. In this manner, the opening cords 118 and front sheets 114 are lowered to the lowermost position (closed) under the weight of the shaping plates 117, returning to the position shown in FIGS. 30 and 31. However, the opening and closing of the front sheets 94 can be stopped at any position using the stopper 112*d* if one desires to fix the front sheets 114 in another position, e.g., in a halfway position. Therefore, as the rear sheet 110 is exposed through the openings 144, the shade can change in appearance, including shape, color, texture, and pattern. Furthermore, when a transparent or semitransparent material is used to form the rear sheet 110, a view is obtained through the openings 144.

Figure 34:
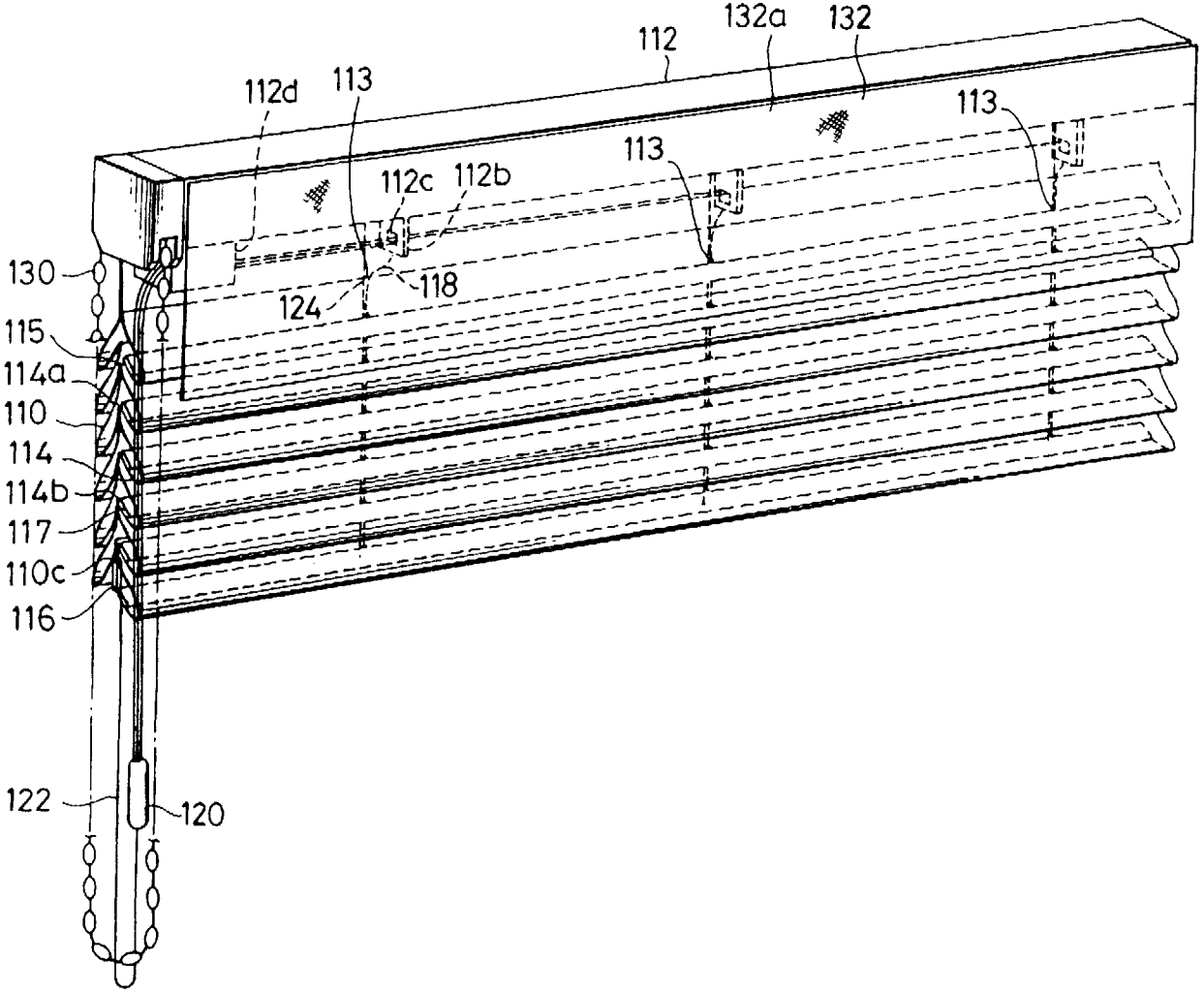
FIG. 34 is a perspective view of the roman shade of FIG. 32, in which a rear sheet is raised.

In order to raise the rear sheet 10 (i.e., to raise the shade), the pulley is driven in a winding (raising) direction of the raising cords 124 by operating the ball-chain 130. The anchor end portions of the raising cords 124 are thereby wound on the drum 124. As shown in FIG. 34, the anchor end portions of the raising cords 124 are drawn up, while the ballast bar 116 is raised together with the anchor end portions. As with the first embodiment, as the ballast bar 116 is drawn into contact with the upper end 114 of the lowermost front sheet 114, the attachments to the front sheets (adjacent to one another in the vertical direction) are brought in order into contact with one another, forming regular folds between the attachments. The folds in the rear sheet 110 extend over the full lateral width of the rear sheet 110 and project backwards. Accordingly, as shown in FIG. 34, the front sheets 114 are raised together (forming folds projecting forwards) with the rear sheet 110. That is, the shade is raised. Since the back rear sheet 110 and the front sheets 114 do not lie upon one another, they are not bulky, and the front sheets 114 can be folded neatly.

By operating the ball-chain 130 and rotating the pulley in a rewinding direction of the raising cords 124, the raising cords 124 are unwound (lowered) from the drum 126. Consequently, the ballast bar 116 is lowered under its own weight, and the rear sheet 110 is lowered in a stepwise fashion, the folds unfolding in order from the bottom of the rear sheet. In this manner, the front sheets 114 are also lowered and unfolding in order from the lowermost front sheet 114.

Accordingly, the raising or lowering of the rear sheet 110 (and the entire shade) can be stopped at any position using the ball-chain 130, and the opening and closing of the front sheets 114 can be stopped at any position using the stopper 112*d*.

Figure 35:
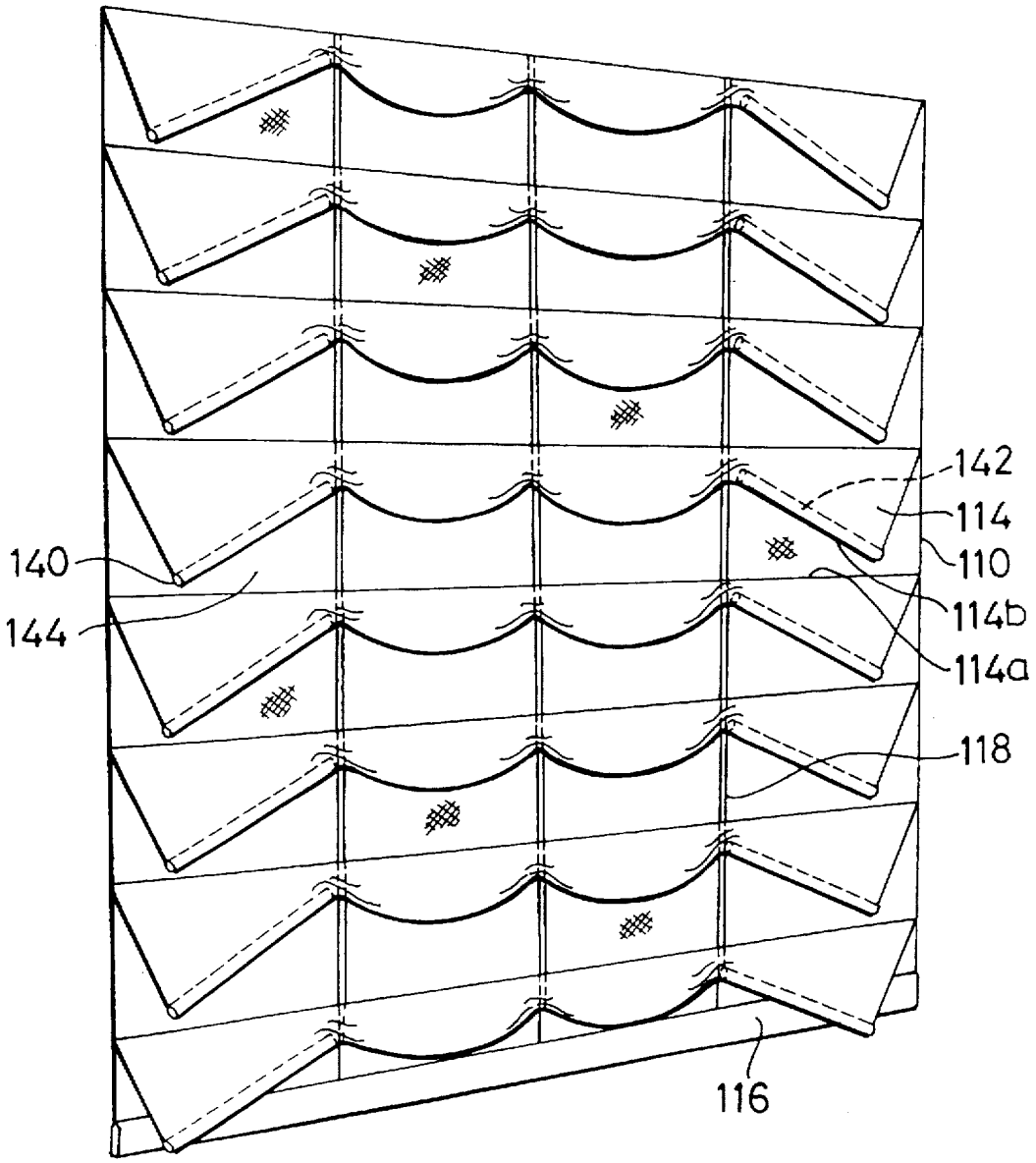
FIG. 35 is a perspective of a thirteenth embodiment of a roman shade according to the present invention.

FIG. 35 shows a thirteenth embodiment of a roman shade according to the present invention. As shown in FIG. 35, the thirteenth embodiment has the same general structure as the twelfth embodiment, exceptions including that left and right lateral bars 140 and 142 are attached to the lower ends 114*b* of the front sheets 114, and extend from both left and right side end portions of each individual front sheet 114 towards the center thereof. The inner end portions of the left and right lateral bars 140 and 142 are attached to the opening cords 118. In addition, as shown in FIG. 35, one of the opening cords 118 is preferably attached to the center portion of each front sheet 140, giving a total of three opening cords 118.

In the thirteenth embodiment, the opening action of the front sheets 114 and the raising action of the rear sheet 110 (raised together with the front sheets 114) are performed in a manner similar to that of the twelfth embodiment. However, since the left and right lateral bars 140 and 142 are attached to the opening cords 118, but do not extend across the full lateral width of the front sheets 114, when the front sheets 114 are raised, the left and right lateral bars 140 and 142 incline linearly upward as shown in FIG. 35. The unsupported portions of the center of the front sheets 114 form draped wave-like shapes along the lateral direction. Accordingly, draped openings 144 having a draped shape including straight lines and curves are formed between the lower end portion 114*b* of each front sheet 114 and the upper end 114*a* of the next lower front sheet 114, and between the lower end portion 114*d* of the lowermost front sheet 114 and the ballast bar 116. Therefore, as the rear sheet 110 is exposed through the openings 144, the shade can change in appearance, including shape, color, texture, and pattern. Furthermore, when a transparent or semitransparent material is used to form the rear sheet 110, a view is obtained through the openings 144.

In order to close (i.e., lower) the front sheets 114, the same operation as in the twelfth embodiment is performed, returning the front sheets 114 to the closed state (not shown). In order to raise the rear sheet 110 (i.e., in order to raise the roman shade), the same operation as in the twelfth embodiment is performed. Accordingly, the raising or lowering of the rear sheet 110 (and the entire shade) can be stopped at any position using the ball-chain 130, and the opening and closing of the front sheets 114 can be stopped at any position using the stopper 112*d*.

Figure 36:
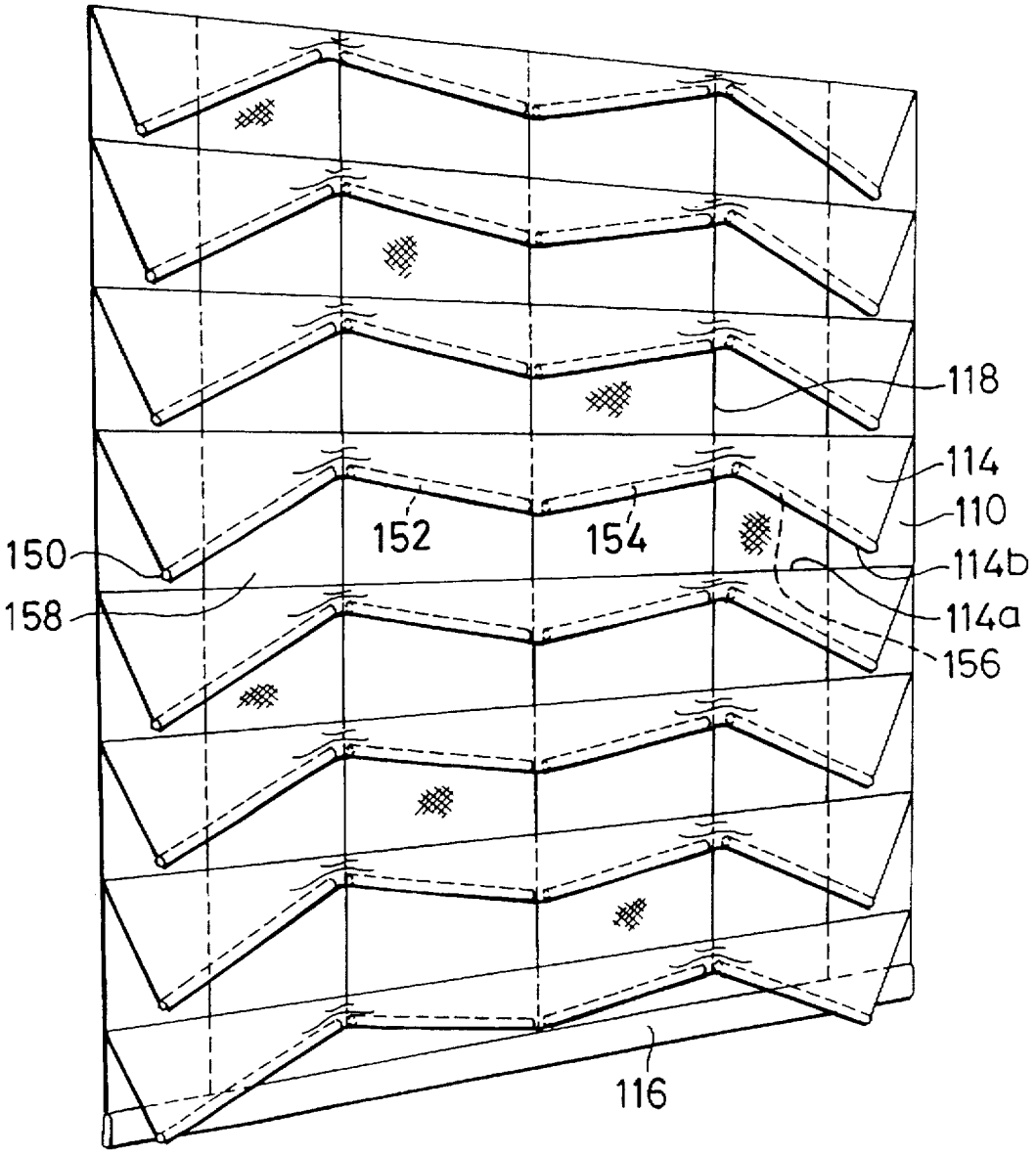
FIG. 36 is a perspective view of a fourteenth embodiment of a roman shade according to the present invention.

FIG. 36 shows a fourteenth embodiment of a roman shade according to the present invention. As shown in FIG. 36, the fourteenth embodiment has the same general structure as the twelfth embodiment, exceptions including that four lateral bars 150, 152, 154, and 156 are arranged in series and attached to the lower ends 114*b* of the front sheets 114. The opening cords 118 are preferably joined to the front sheets 114 at points where the first two lateral bars 150 and 152 meet, and where the second two lateral bars 154 and 156 meet. Accordingly, when the opening cords are drawn up, the front sheets 114 are drawn up in a jagged shape formed from straight lines.

In the fourteenth embodiment, the opening action of the front sheets 114 and the raising action of the rear sheet 110 (raised together with the front sheets 114) are performed in a manner similar to that of the twelfth embodiment. However, since the four lateral bars 150, 152, 154, and 156 are arranged in series, and the opening cords 118 are joined to the front sheets 114 at points where successive lateral bars 150, 152 and 154, 156 meet, when the front sheets 114 are raised, all four lateral bars 150, 152, 154, 156 incline linearly upward as shown in FIG. 36. That is, from the viewpoint of FIG. 36, in order from the left hand side, the lateral bars 150 incline linearly upward to the right, the lateral bars 152 incline linearly downward to the right, the lateral bars 154 incline linearly upward to the right, and the lateral bars 156 incline linearly downward to the right. The front sheets 114 form a jagged shape along the lateral direction.

Accordingly, jagged openings 158 having a jagged shape made of straight lines (i.e., having a waveform of straight lines) are formed between the lower end portion 114*b* of each front sheet 114 and the upper end 114*a* of the next lower front sheet 114, and between the lower end portion 114*d* of the lowermost front sheet 114 and the ballast bar 116. Therefore, as the rear sheet 110 is exposed through the openings 158, the shade can change in appearance, including shape, color, texture, and pattern. Furthermore, when a transparent or semitransparent material is used to form the rear sheet 110, a view is obtained through the openings 158.

In order to close (i.e., lower) the front sheets 114, the same operation as in the twelfth embodiment is performed, returning the front sheets 114 to the closed state (not shown). In order to raise the rear sheet 110 (i.e., in order to raise the roman shade), the same operation as in the twelfth embodiment is performed. Accordingly, the raising or lowering of the rear sheet 110 (and the entire shade) can be stopped at any position using the ball-chain 130, and the opening and closing of the front sheets 114 can be stopped at any position using the stopper 112*d*.

Figure 37:
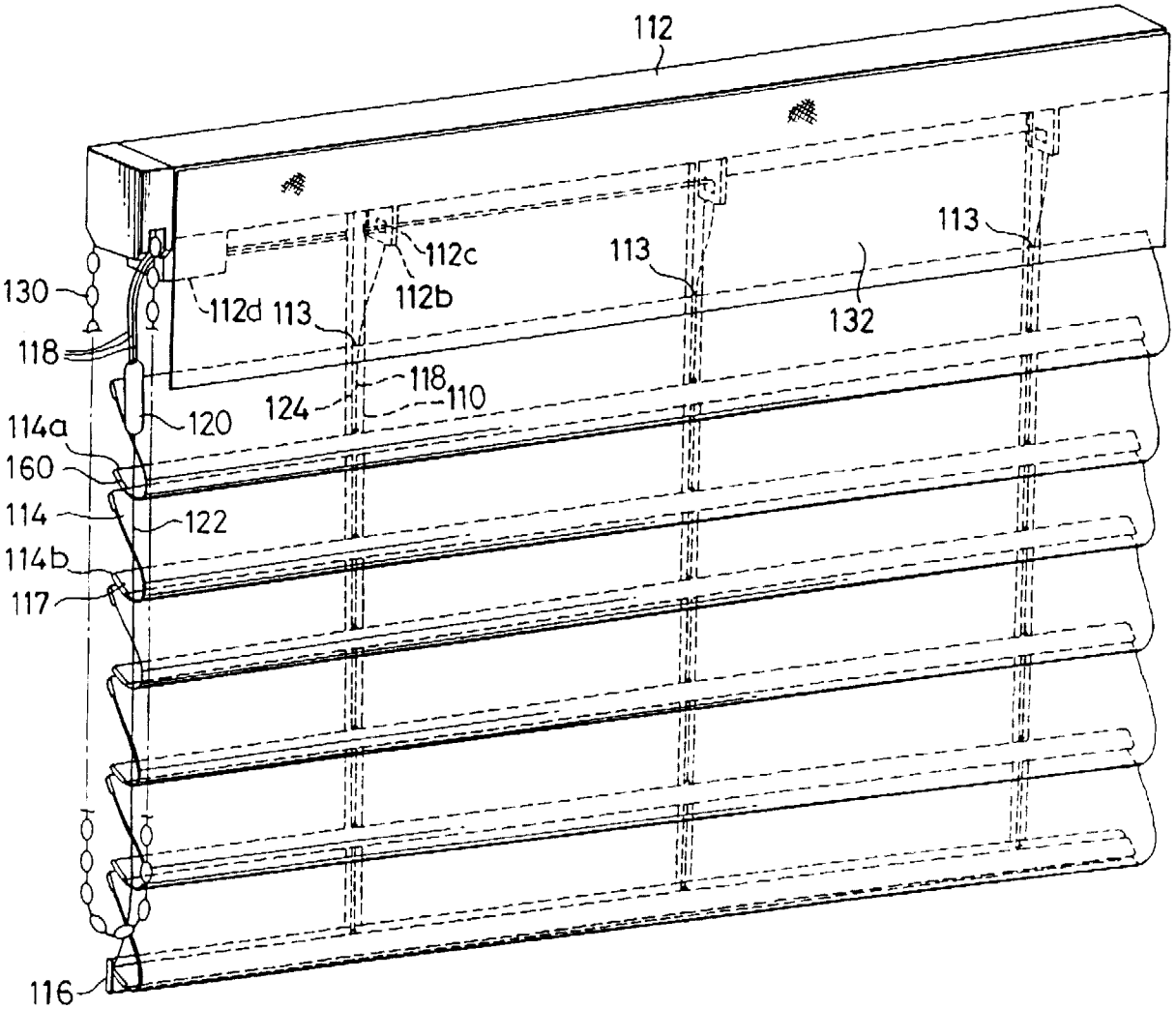
FIG. 37 is a perspective view of a fifteenth embodiment of a roman shade according to the present invention.
Figure 38:
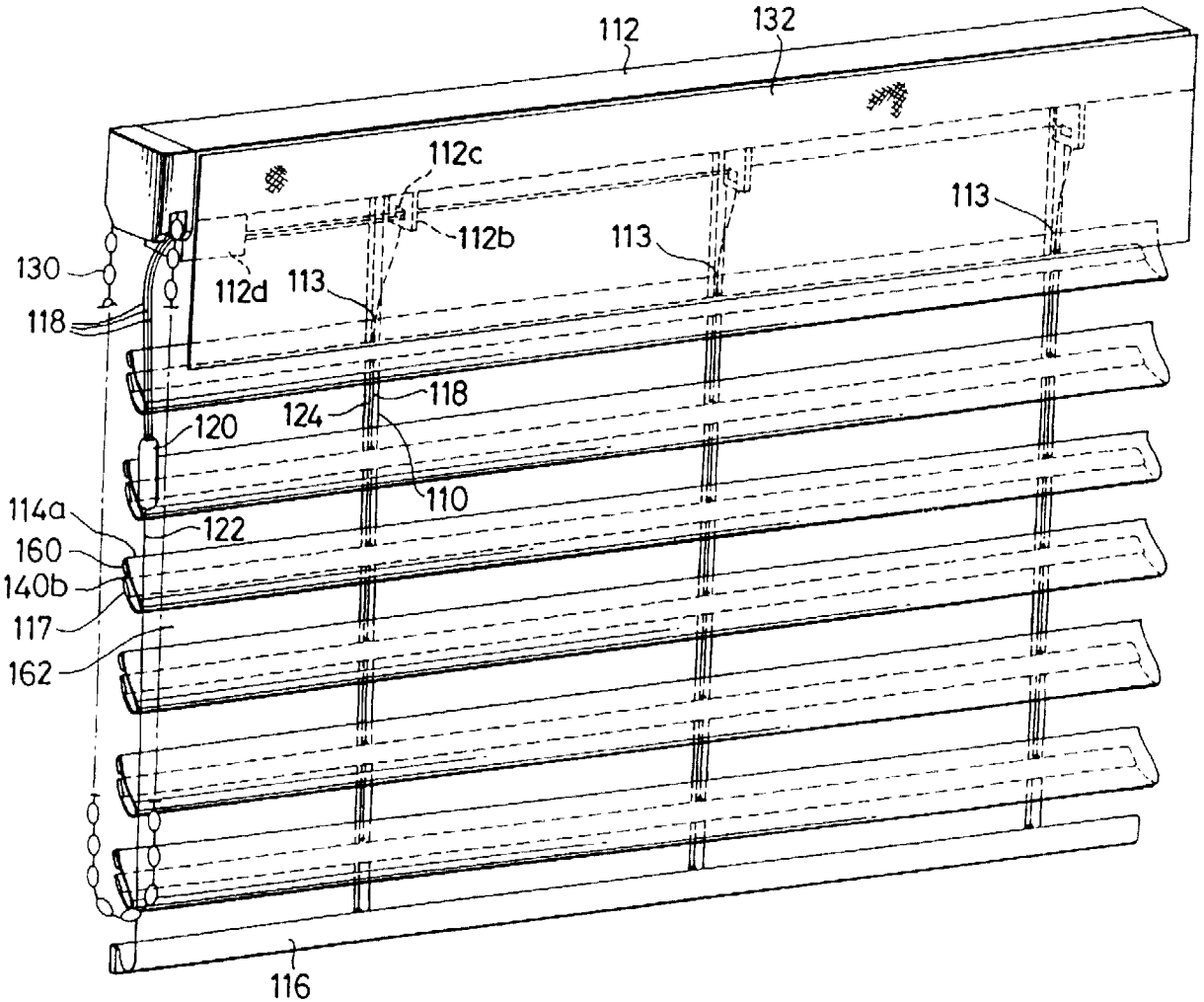
FIG. 38 is a perspective view of the roman shade of FIG. 37, in which front sheets are opened.

FIGS. 37 and 38 show a fifteenth embodiment of a roman shade according to the present invention. As shown in FIG. 37, the fifteenth embodiment has the same general structure as the twelfth embodiment, exceptions including that the rear sheet 110 is split into vertical strips laterally positioned to correspond to the positions of the opening cords 118 and raising cords 124. That is, the rear sheet 110 covers only the areas where the opening cords 118, raising cords 124, and insertion extensions 113 are present, and has sufficient width at each strip for the front sheets 114 to connect thereto. As shown in FIG. 37, each front sheet 114 is preferably provided with a top plate 116 at an upper portion 114*a* thereof, each top plate 116 being attached to the corresponding front sheet 114 across the entire lateral width, and each top plate 116 being attached to the rear sheet (strips) 110.

In the fifteenth embodiment, the opening action of the front sheets 114 and the raising action of the rear sheet 110 (raised together with the front sheets 114) are performed in a manner similar to that of the twelfth embodiment. When the front sheets 114 are opened as shown in FIG. 38, openings 162 having a rectangular shape are formed between the lower end portion 114*b* of each front sheet 114 and the upper end 114*a* of the next lower front sheet 114, and between the lower end portion 114*d* of the lowermost front sheet 114 and the ballast bar 116, as in the twelfth embodiment. However, since the rear sheet 110 is provided only in narrow vertical strips, an unshaded view (i.e., via a through-opening) is obtained through the openings 162. Therefore, as the rear sheet 110 is exposed through the openings 162, the shade can change in appearance, including shape, color, texture, and pattern. Furthermore, it is not necessary to use a transparent or semitransparent material to form the rear sheet 110 in order to obtain a view through the openings 162.

In order to close (i.e., lower) the front sheets 114, the same operation as in the twelfth embodiment is performed, returning the front sheets 114 to the closed state shown in FIG. 37. In order to raise the rear sheet 110 (i.e., in order to raise the roman shade), the same operation as in the twelfth embodiment is performed. Accordingly, the raising or lowering of the rear sheet 110 (and the entire shade) can be stopped at any position using the ball-chain 130, and the opening and closing of the front sheets 114 can be stopped at any position using the stopper 112*d*.

In FIGS. 37 and 38, the rear sheets 110 are provided in the shape of narrow vertical strips only for portions where the opening cords 118 and raising cords 124 hang down. However, different structures may be used without departing from the spirit and scope of the invention. For example, additional vertical strips may be provided in lateral positions other than those of the opening cords 118 and raising cords 124. Alternatively, in the embodiments as described, where each front sheet incorporates pass-through holes for inserting the opening cords and raising cords, the width of the vertical strips may be made sufficient for supporting the front sheets.

In the twelfth through fifteenth embodiments, the opening cords 118 and raising cords 124 are passed through insertion extensions 113 between the rear sheet 110 and front sheets 114. However, an alternative structure may use pass-through holes formed near the connections of the rear sheet 110 and front sheets 114 instead of the insertion extensions, wherein the opening cords 118 and raising cords 124 are passed through the pass-through holes. In another alternative, the opening cords 118 are not passed through the front sheets 114 or rear sheet 110, but are hung in front of the front sheets 114 and attached thereto.

Further, although the rear sheet 110 in attached to the rear portion 112*a* of the head rail 112, the rear sheet 110 may be alternatively attached to the front side 112*e* of the head rail 112. In this case, when the rear sheet 110 is located farther forward with respect to the positions where the opening cords 118 and raising cords 124 hang down, pass-through holes are preferably formed in the rear sheet 110 at suitable portions thereof, so that the opening cords 118 and raising cords 124 can be passed through the pass-through holes and in front of the rear sheet 110.

Still further, although the raising cords 124 are wound on the drum 126 and the opening cords 118 are controlled through the stopper 112*d* and opening grip 120, the present invention is not restricted to this structure. Alternatively, the opening cords 118 may be wound on a drum and the raising cords 124 controlled by a stopper and grip. In further alternatives, both cords 118 and 124 may be on drums, or both cords may be provided with respective stoppers and grips.

In all the embodiments, the connection of the front sheets and opening cords may be formed by sewing the opening cords directly to the front sheets. Alternatively, connection rings may be attached to the front sheets or lateral bars (if present), and the opening cords may be connected to or sewn to the connection rings.

Further, in all the embodiments, the front sheets and rear sheet may be formed from materials, colors, or patterns differing from one another, allowing the selection of more than one kind of sheet per shade.

Still further, in all the embodiments, the front sheets are operable by the opening grip or the opening cord itself, while the rear sheets are operable by the raising grip or the raising cord itself. Optionally, one or both of the grips are not provided.

Although the head rail in several embodiments includes a system including cord guides for controlling the raising cords and opening cords and for introducing the pulling ends of the cords beyond the end of the head rail, stoppers for restraining the cords, and grips for operating the cords, the present invention is not restricted to this particular structure. For example, a system may be alternatively provided in which a drum is provided at or within the head rail, one or both of the raising cords or the opening cords being wound on the drum for winding and rewinding. One end of a rotation axis rotating with the drum can be provided with a pulley so that the winding of the drum is controlled with a control chain.

Furthermore, although in all described embodiments the front sheets are commonly connected to opening cords, the invention may be alternatively structured such that sets of opening cords control different sets of front sheets. For example, sets of adjacent front sheets may be controlled with corresponding sets of opening cords, or sets of alternating front sheets may be controlled with corresponding sets of opening cords. In another alternative, a set of front sheets that is not connected to opening cords may be formed.

Other modifications of the invention will be readily apparent to those skilled in the art, and it is intended that the scope of the invention be determined solely by the appended claims.

Each of the described embodiments of the invention, by exposing a rear sheet having any appearance, allows a dramatic change in the appearance of the shade. If the rear sheet is transparent, semitransparent, or provided in strips, a viewing function and a screening function are provided, and the amount of light admitted through the front sheets of shade can be regulated. The shade may be fully or partially raised and lowered, while the front sheets may be fully or partially opened or closed.

The present disclosure relates to subject matter contained in Japanese Patent Application No. HEI 7-327694, filed on Dec. 15, 1995; No. HEI 8-8361, filed on Jan. 22, 1996; and No. HEI 8-72113, filed on Mar. 27, 1996, which are expressly incorporated herein by reference in their entireties.

What is claimed is:

1. A roman shade, comprising:

a head rail;

a ballast bar;

a rear sheet connected to the head rail and to the ballast bar;

a raising cord extending along a face of said rear sheet from said head rail and connected to said ballast bar;

a plurality of front sheets arranged at predetermined vertical intervals facing said rear sheet, each of said front sheets having an attachment that attaches to a front face of said rear sheet; and an opening cord extending vertically from said head rail and connected to each of said plurality of front sheets at a first predetermined position displaced from said attachment, said opening cord being vertically movable.

2. The roman shade according to claim 1, said plurality of front sheets being raised by said opening cord to expose said rear sheet through a plurality of openings corresponding to said raised front sheets, said plurality of openings being of varying size depending on an amount of raising of said front sheets.

3. The roman shade according to claim 1, further comprising:

at least one stopper, positioned inside said head rail, for restraining at least one of said raising cord and said opening cord introduced through said at least one stopper to the outside of said head rail.

4. The roman shade according to claim 1, further comprising:

at least one drum, positioned inside said head rail, for winding at least one of said raising cord and said opening cord on said at least one drum; and at least one drum drive, said at least one drum drive being externally controlled.

5. The roman shade according to claim 1, wherein said first predetermined position is a lower end of each of said plurality of front sheets, and wherein said opening cord is passed through each of said front sheets at a second predetermined position nearer to said attachment than said first predetermined position.

6. The roman shade according to claim 5, wherein each of said front sheets forms a fold between said second predetermined position where said opening cord passes through said front sheet and said first predetermined position at a lower end of said front sheet.

7. A roman shade, comprising:

a head rail;

a rear sheet connected to the head rail;

a plurality of front sheets arranged at predetermined vertical intervals facing said rear sheet, each of said front sheets having an attachment that attaches to a front face of said rear sheet;

a raising cord for raising and lowering said rear sheet, said raising cord extending from said head rail and passing through each of said attachments; and an opening cord extending vertically from said head rail, and connected to each of said plurality of front sheets at a first predetermined position displaced from said attachment, said opening cord being vertically movable.

8. The roman shade according to claim 7, said plurality of front sheets being raised by said opening cord to expose said rear sheet through a plurality of openings corresponding to said raised front sheets, said plurality of openings being of varying size depending on an amount of raising of said front sheets.

9. The roman shade according to claim 7, further comprising:

at least one stopper, positioned inside said head rail, for restraining at least one of said raising cord and said opening cord introduced through said at least one stopper to the outside of said head rail.

10. The roman shade according to claim 7, further comprising:

at least one drum, positioned inside said head rail, for winding at least one of said raising cord and said opening cord on said at least one drum; and at least one drum drive, said at least one drum drive being externally controlled.

11. The roman shade according to claim 7, wherein said first predetermined position corresponds to a lower end of each front sheet, and wherein said opening cord is passed through each of said front sheets at a second predetermined position nearer to said attachment than said first predetermined position.

12. The roman shade according to claim 7, wherein each of said front sheets forms a fold between said second predetermined position where said opening cord passes through said front sheet and said first predetermined position at a lower end of said front sheet.

13. The roman shade according to claim 7, wherein said rear sheet is connected to said head rail at a rear portion of said head rail, and said raising cord extends along a front face of said rear sheet.

14. The roman shade according to either of claims 1 or 7, further comprising:

a plurality of lower lateral bars corresponding to said plurality of front sheets, each front sheet being attached to a corresponding lower lateral bar at a lower end portion of each front sheet, and each lower lateral bar extending laterally across the corresponding front sheet.

15. The roman shade according to claim 14, said plurality of front sheets being raised by said opening cord to expose said rear sheet through a plurality of openings corresponding to said raised front sheets, said plurality of openings being of varying size depending on an amount of raising of said front sheets, and said plurality of openings having rectilinear top edges at positions corresponding to said lower lateral bars.

16. The roman shade according to claim 8, further comprising:

a valance cloth hanging from said head rail for covering an upper end portion of an uppermost front sheet of said plurality of front sheets.

17. A roman shade, comprising:

a hanging rear sheet;

a plurality of foldable front sheets attached at vertical intervals to said rear sheet and hanging from said rear sheet, each of said front sheets movable between a hanging, unfolded state and a folded state;

a raising cord operatively connected to said rear sheet so that said rear sheet is raised and lowered together with said plurality of front sheets, said raising cord being capable of raising the rear sheet over a substantial portion of a hanging length of the rear sheet;

an opening cord operatively connected to said front sheets so that said front sheets are opened in said folded state and closed in said hanging, unfolded state with respect to said rear sheet; and at least one ballast portion for weighting and straightening the roman shade.

18. The roman shade according to claim 17, wherein said front sheets are attached at an upper end thereof to said rear sheet, and operatively connected at a lower end thereof to said opening cord, so that said front sheets form folds when said front sheets are opened with respect to said rear sheet.

* * * * *

UNITED STATES PATENT AND TRADEMARK OFFICE

CERTIFICATE OF CORRECTION

PATENT NO. : 5,787,951

DATED : August 4, 1998

INVENTOR(S) : H. TOMOMURA et al.

It is certified that error appears in the above-identified patent and that said Letters Patent is hereby corrected as shown below:

On the title page, insert —Section [30], "Foreign Application Priority Data" Dec. 15, 1995 [JP] Japan 7-327694; Jan. 22, 1996 [JP] Japan 8-8361; Mar. 27, 1996 [JP] 8-72113---.

On the title page, at item [57], "ABSTRACT", line 2 change "ber" to —bar---.

Signed and Sealed this

Twenty-first Day of March, 2000

*Attest:*

*Attesting Officer*

Q. TODD DICKINSON

*Commissioner of Patents and Trademarks*